US009024785B2

(12) United States Patent
Mochizuki et al.

(10) Patent No.: US 9,024,785 B2
(45) Date of Patent: May 5, 2015

(54) TRAFFIC INFORMATION DISTRIBUTION SYSTEM AND TRAFFIC INFORMATION SYSTEM, TRAFFIC INFORMATION DISTRIBUTION PROGRAM, AND TRAFFIC INFORMATION DISTRIBUTION METHOD

(71) Applicants: Atsushi Mochizuki, Okazaki (JP); Tomoki Kubota, Okazaki (JP); Hiroaki Sugiura, Okazaki (JP); Masatoshi Takahara, Okazaki (JP)

(72) Inventors: Atsushi Mochizuki, Okazaki (JP); Tomoki Kubota, Okazaki (JP); Hiroaki Sugiura, Okazaki (JP); Masatoshi Takahara, Okazaki (JP)

(73) Assignee: Aisin AW Co., Ltd., Anjo (JP)

( * ) Notice: Subject to any disclaimer, the term of this patent is extended or adjusted under 35 U.S.C. 154(b) by 146 days.

(21) Appl. No.: 13/712,302

(22) Filed: Dec. 12, 2012

(65) Prior Publication Data

US 2013/0162448 A1 Jun. 27, 2013

(30) Foreign Application Priority Data

Dec. 27, 2011 (JP) ..... 2011-286507
Feb. 29, 2012 (JP) ..... 2012-044078

(51) Int. Cl.

*G08G 1/09* (2006.01)
*G08G 1/0967* (2006.01)
*G08G 1/01* (2006.01)

(52) U.S. Cl.

CPC ..... *G08G 1/096775* (2013.01); *G08G 1/0112* (2013.01); *G08G 1/096716* (2013.01); *G08G 1/096741* (2013.01)

(58) Field of Classification Search

USPC ..... 340/901–905, 933, 935, 425.5, 436
See application file for complete search history.

(56) References Cited

U.S. PATENT DOCUMENTS

2010/0207787 A1* 8/2010 Catten et al. ..... 340/905

FOREIGN PATENT DOCUMENTS

| | | |
|---|---|---|
| JP | A-2009-140008 | 6/2009 |
| JP | 2010128529 A | 6/2010 |
| JP | A-2010-210435 | 9/2010 |

* cited by examiner

*Primary Examiner* — Daryl Pope
(74) *Attorney, Agent, or Firm* — Oliff PLC

(57) ABSTRACT

Systems, methods, and programs distribute traffic information including information on a wrong-way vehicle traveling in a wrong-way direction opposite to a designated travel direction of a road. The systems, methods, and programs distributes the traffic information to the target vehicle, determine a reporting range of the wrong-way vehicle information based on a wrong-way vehicle position. When an end-point distance is equal to or larger than a predetermined reference distance, the systems, methods, and programs set a wrong-way section as the reporting range. When the end-point distance is less than the reference distance, the systems, methods, and programs set the wrong-way section and at least one road section which is adjacent to the wrong-way section as the reporting range. When the target vehicle is in the reporting range, the systems, methods, and programs send the traffic information including the wrong-way vehicle information to the target vehicle.

13 Claims, 14 Drawing Sheets

TRAFFIC INFORMATION DISTRIBUTION SYSTEM AND TRAFFIC INFORMATION SYSTEM, TRAFFIC INFORMATION DISTRIBUTION PROGRAM, AND TRAFFIC INFORMATION DISTRIBUTION METHOD

INCORPORATION BY REFERENCE

The disclosure of Japanese Patent Application No. 2011-286507, filed on Dec. 27, 2011, and Japanese Patent Application No. 2012-044078, filed on Feb. 29, 2012, including the specifications, drawings and abstracts are incorporated herein by reference in their entirety.

BACKGROUND

1. Related Technical Fields

Related technical fields include traffic information distribution systems that distribute, to a target vehicle, traffic information including wrong-way vehicle information as information on a wrong-way vehicle that is traveling in a wrong-way direction opposite to a designated travel direction of a road, and traffic information systems using such a traffic information distribution system, traffic information distribution programs, and traffic information distribution methods.

2. Related Art

In order to reduce wrong-way entry, signs, etc. that show traffic lane/direction classification are installed on interchanges and ramp ways, which are the junctions of a local road and a road that directs vehicles to travel in one direction such as a highway and a freeway. However, the vehicles may enter a highway, etc. by mistake from a junction as an exit to a local road, and may travel in the wrong direction because the driver overlooks or misunderstands signs, etc. The presence of such a vehicle traveling in a wrong way (a wrong-way vehicle) is not desirable not only for the wrong-way vehicle itself but also for other vehicles that end up traveling in the opposite direction to the wrong-way vehicle.

Japanese Patent Application Publication No. 2010-210435 (JP 2010-210435 A) discloses a technique in which information on links in map database for use in map matching processing of a navigation system is used to determine whether the direction of the link matches the travel direction of a host vehicle, and if the direction of the link does not match the travel direction of the host vehicle, it is determined that the vehicle is traveling in a wrong direction (paragraph [0016], etc.). Japanese Patent Application Publication No. 2009-140008 (JP 2009-140008 A) discloses an information providing system including an in-vehicle device and a ground processing center. The in-vehicle device is capable of uplinking information such as information on the travel track of the vehicle having the in-vehicle device mounted thereon, information on the speed of the vehicle, and information on whether the vehicle is traveling in a wrong direction to the ground processing center. The ground processing center reports the presence of a wrong-way vehicle to a vehicle having the in-vehicle device mounted thereon, or an electric display board installed on a road. For example, the ground processing center transmits warning information to the in-vehicle device mounted on the vehicle approaching the wrong-way vehicle (paragraphs [0013] to [0015], [0029] to [0034], FIGS. 1 and 6, etc.).

Traveling lanes of highways have connection roads to local roads, such as interchanges and ramp ways, and branches between a rest area and a connection road. Thus, even if the wrong-way vehicle is approaching, the wrong-way vehicle may turn off the traveling lane from a branch. If the vehicle receiving the information on the wrong-way vehicle is located away from the wrong-way vehicle, the wrong-way state may be eliminated before the vehicle reaches the position where the wrong-way vehicle is present. In this case, even if the vehicle receives the warning information on the wrong-way vehicle, this information is less likely to be used by the user. In such a case, sending the warning information to the user may bother the user.

SUMMARY

Exemplary implementations of the broad inventive principles described herein provide a technique that accurately reports the presence of a wrong-way vehicle to a vehicle that is present in an appropriate range.

Exemplary implementations provide systems, methods, and programs that distribute traffic information including information on a wrong-way vehicle traveling in a wrong-way direction opposite to a designated travel direction of a road. The systems, methods, and programs distributes the traffic information to the target vehicle, determine a reporting range of the wrong-way vehicle information based on a wrong-way vehicle position. When an end-point distance is equal to or larger than a predetermined reference distance, the systems, methods, and programs set a wrong-way section as the reporting range. When the end-point distance is less than the reference distance, the systems, methods, and programs set the wrong-way section and at least one road section which is adjacent to the wrong-way section as the reporting range. When the target vehicle is in the reporting range, the systems, methods, and programs send the traffic information including the wrong-way vehicle information to the target vehicle.

DETAILED DESCRIPTION OF EXEMPLARY IMPLEMENTATIONS

Figure 1:
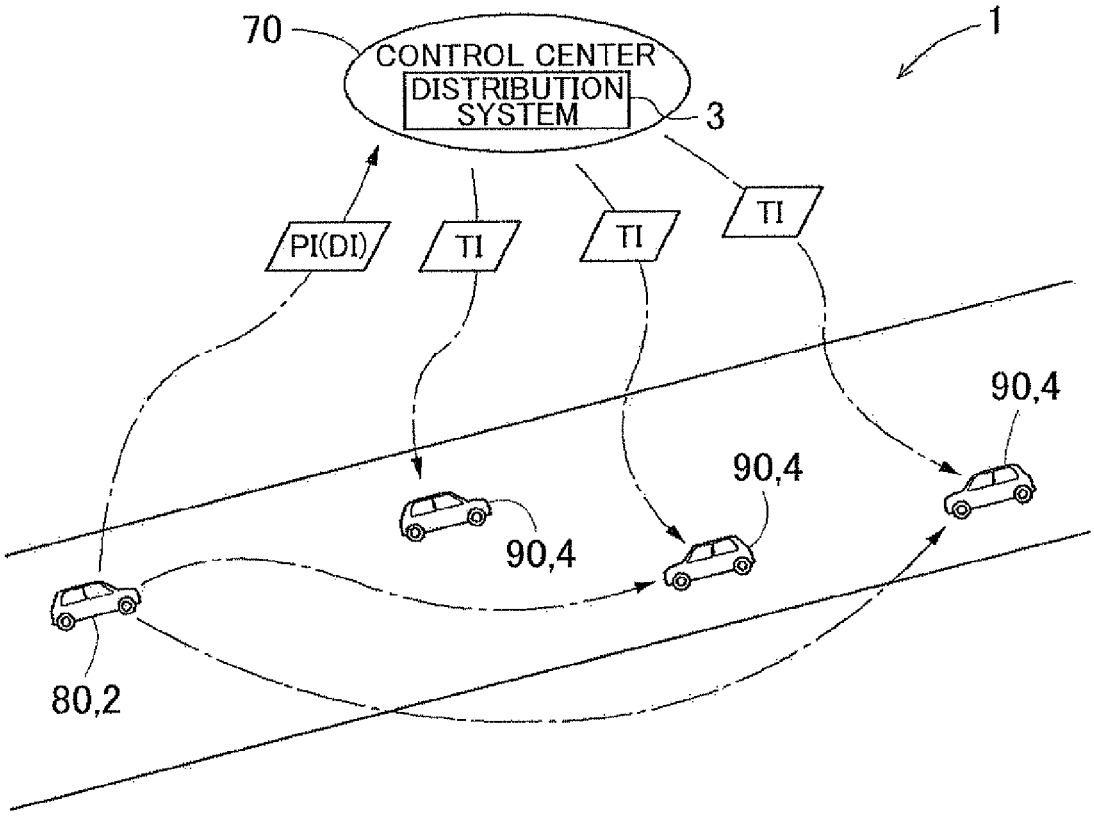
FIG. 1 schematically shows the configuration of a traffic information system.
Figure 2:
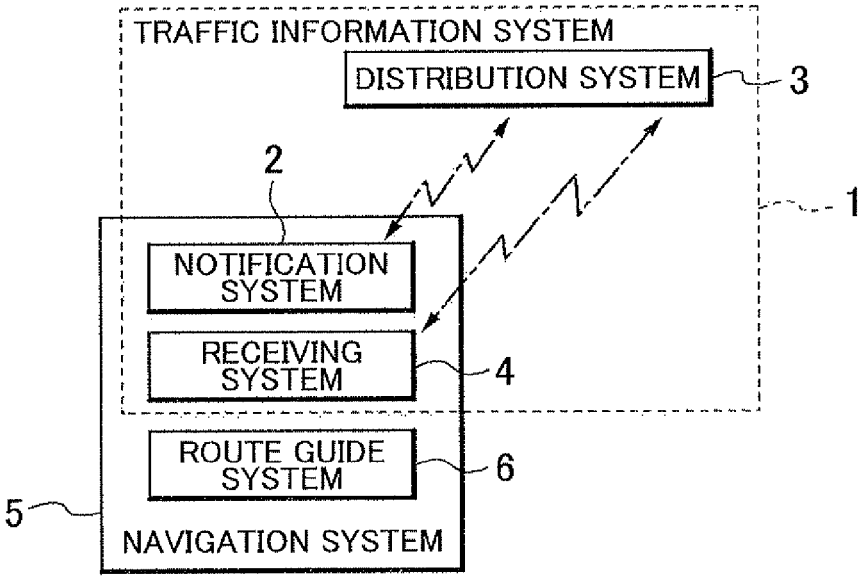
FIG. 2 is a schematic block diagram showing the relation between the traffic information system and a navigation system.
Figure 3A:
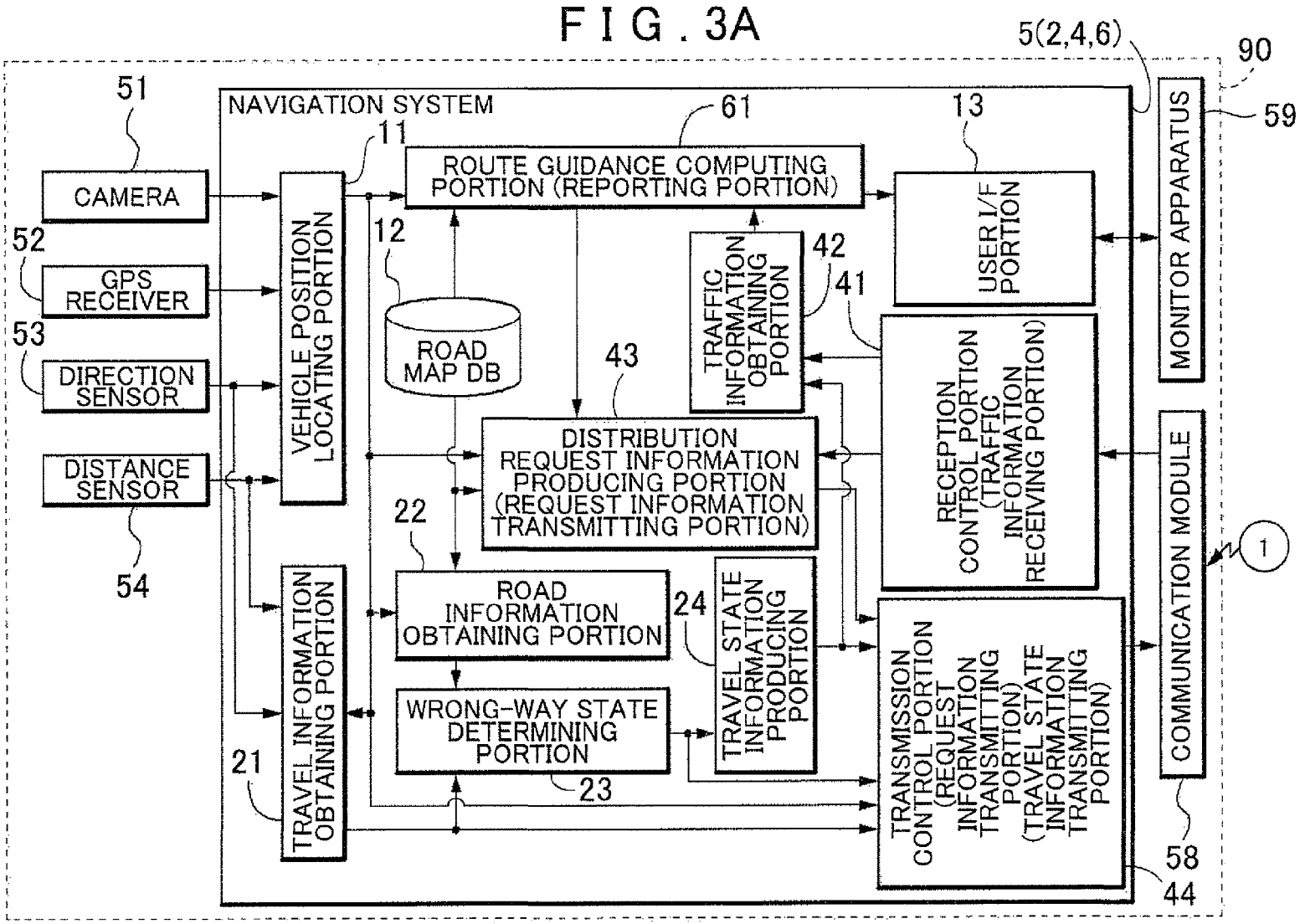
FIG. 3A and FIG. 3B are a schematic block diagram of the traffic information system and the navigation system.
Figure 3B:
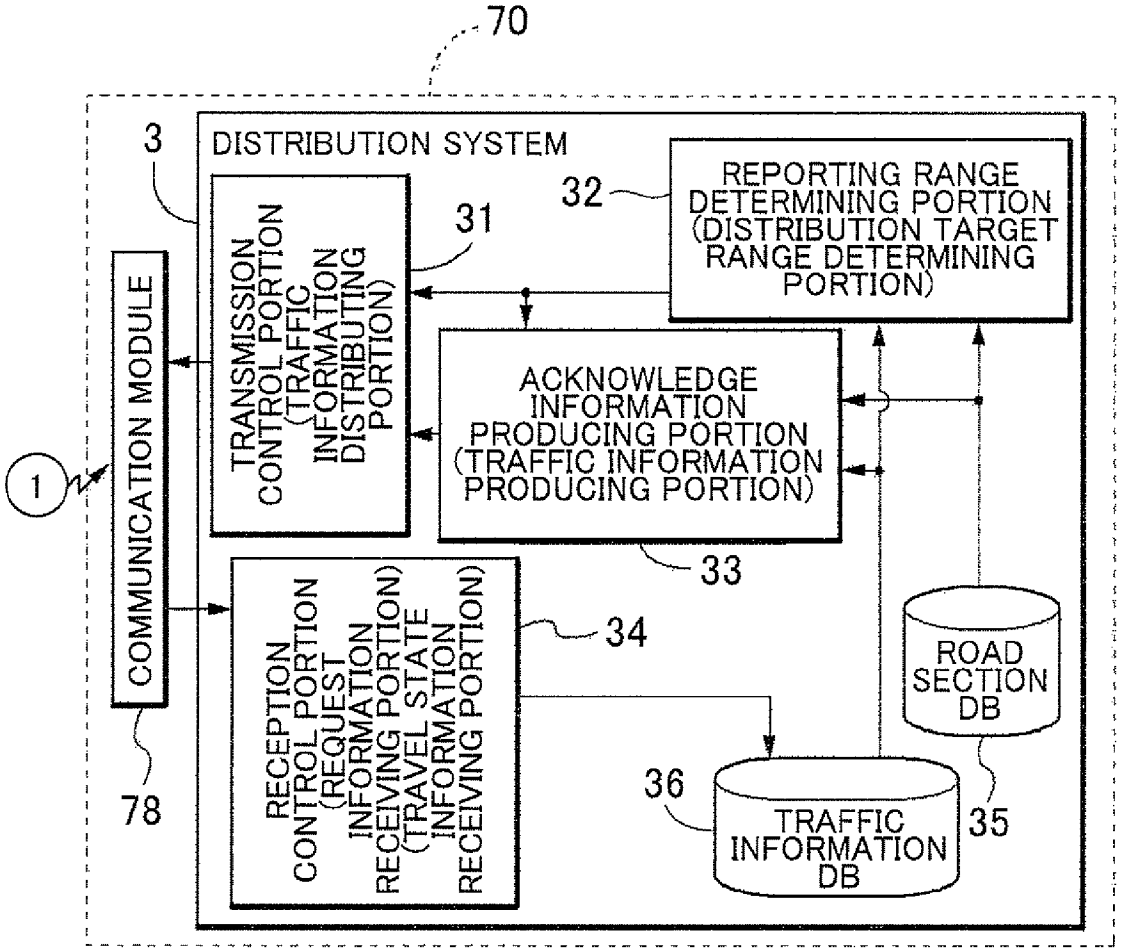

FIG. 1 schematically shows the configuration of a traffic information system 1 including a traffic information distribution system (a distribution system 3). This traffic information system 1 is a system that collects various traffic information such as traffic jam information, road condition information, and travel information of vehicles that are traveling on a road, and provides the collected traffic information to vehicles, etc. In the present example, as shown in FIG. 2, the traffic information system 1 includes a notification system 2 (a traffic information notification system), a distribution system 3 (a traffic information distribution system), and a receiving system 4 (a traffic information receiving system). Traffic information is collected by the notification system 2 including a fixed apparatus installed on a road and a moving apparatus mounted on a vehicle (a probe vehicle 80), and is transmitted to the distribution system 3 as a notification target. The distribution system 3 collects the traffic information received from the notification system 2, and distributes the traffic information to the receiving system 4 as necessary. The distribution system 3 is preferably configured by using as a core a computer that functions as a server in a fixed facility such as a control center 70. The distribution system 3 has a plurality of functional parts as shown in FIGS. 3A and 3B, and each system is implemented by cooperation between hardware such as a controller (e.g., a microprocessor or a digital signal processor (DSP)), or a memory and software such as a program or a parameter stored in a computer-readable storage medium. (Note: the term "storage medium" as used herein is not intended to encompass transitory signals.)

The notification system 2 is mounted on, e.g., the probe vehicle 80 shown in FIG. 1. That is, the probe vehicle 80 includes the notification system 2 capable of transmitting, as probe information PI, travel condition information DI such as the vehicle position (the probe vehicle position), the travel speed of the vehicle, the travel track of the vehicle, etc. to the distribution system 3. This probe information PI is distributed as traffic information TI to a vehicle having the receiving system 4 mounted thereon (a target vehicle 90) via the distribution system 3. The probe vehicle 80 and the target vehicle 90 may have both the notification system 2 and the receiving system 4. That is, it is preferable that a navigation system 5 including the notification system 2 and the receiving system 4 as shown in FIG. 2 be mounted on each vehicle (80, 90). It is preferable that the distribution system 3 be formed by using the server as a core, whereas it is preferable that the navigation system 5 including the notification system 2 and the receiving system 4 be formed by using as a core a controller (e.g., a computer) that functions as a client in each vehicle (80, 90). It should be understood that each vehicle (80, 90) may include only one of the notification system 2 and the receiving system 4.

As shown in FIG. 2, in the present example, the navigation system 5 has the notification system 2, the receiving system 4, and a route guidance system 6. The route guidance system 6 is a system that provides route guidance to a destination set by the user, and provides various types of information while the vehicle is traveling on the route. Each of the systems forming the navigation system 5 is implemented by cooperation between hardware such as a controller (e.g., a microprocessor or a DSP), or a memory and software such as a program or a parameter stored in a computer-readable storage medium. As shown in FIGS. 3A and 3B, each system has a plurality of functional parts. In the present example, each functional part is common to the plurality of systems.

A route guidance computing portion 61 is a functional part that serves as a core of the navigation system 5 and the route guidance system 6. The route guidance computing portion 61 provides route guidance to a destination and various types of information at a vehicle position, based on the position (the vehicle position) where the navigation system 5 (or the probe vehicle 80 or the target vehicle 90) is present. The route guidance computing portion 61 includes, e.g., a destination setting portion that sets a destination to be searched for, a route searching portion that searches for a route from a search start position to the destination to be searched for, and a route guidance information computing portion that provides route guidance to the destination to be searched for, and provides various types of information at the vehicle position (not shown).

As described in detail later, the route guidance computing portion 61 functions also as a reporting portion that sends, e.g., a caution about a wrong-way vehicle to the user. The guidance, information, and report of the route guidance computing portion 61 are provided to the user via, e.g., a user interface portion 13 (a user I/F portion) and a monitor apparatus 59. The monitor apparatus 59 includes a speaker, a touch panel, etc., and can also provide voice guidance for the user and receive a command input from the user. For example, command inputs from the user, such as setting a destination to be searched for, and changing the type of destination to be searched for, are transmitted to the route guidance computing portion 61 via the touch panel and the user interface portion 13. The probe information PI (the travel condition information DI) that is transmitted by the notification system 2 and the traffic information TI that is received by the receiving system 4 are also transmitted to the route guidance computing portion 61 via a traffic information obtaining portion 42, and are reported to the user via the monitor apparatus 59.

A vehicle position locating portion 11 successively locates the vehicle position (the probe vehicle position or the target vehicle position) as a position where the probe vehicle 80 or the target vehicle 90 is present, and updates information on the vehicle position. If the probe vehicle 80 is a wrong-way vehicle described below, the vehicle position locating portion 11 locates the wrong-way vehicle position. The vehicle position locating portion 11 locates the vehicle position by performing computation using measurement by a global positioning system (GPS) or autonomous control by dead-reckoning, based on information obtained by a GPS receiver 52, a direction sensor 53, a distance sensor 54, etc. In the case where a camera 51 is mounted on the probe vehicle 80 and the target vehicle 90, the vehicle position locating portion 11 may further has a feature recognizing function in order to increase position accuracy. That is, the vehicle position locating portion 11 may locate the vehicle position by performing image recognition of features such as road markings (paint) provided on the road surface, etc., based on image data obtained by shooting an area around the vehicle, and checking the image recognition result with position information of road display which is stored in a road map database 12.

The road map database 12 (a road map DB) is a database including information on a road network. For example, the road map database 12 includes information such as connection information between roads (a connection point: a node, and a road between the connection points: a link), road type (types such as a highway, a toll road, a national road, and a prefectural road), road length, road shape, road width, traffic lane/direction classification, etc. The traffic lane/direction classification includes a designated travel direction of the road such as a highway. The road map database 12 further includes information on various highway facilities (rest areas, parking areas, interchanges, ramps, and junctions). The road map database 12 may further include information on various kinds of features provided on the road or around the road (e.g., road markings, road signs, signals, traffic signs, overpasses, and tunnels). For example, the vehicle position locating portion 11 can locate the vehicle position by using an image shot by the camera 51, and the feature information.

A travel information obtaining portion 21 is a functional part that obtains information (travel information) that is used to produce the travel condition information DI (the probe information PI) to be transmitted from the notification system 2. For example, the travel information obtaining portion 21 obtains the travel direction of the probe vehicle 80 based on the detection result of the direction sensor 53, and obtains the travel speed and the travel distance of the probe vehicle 80 based on the detection result of the distance sensor 54. The travel information obtaining portion 21 also obtains the vehicle position (the probe vehicle position) located by the vehicle position locating portion 11, as information that is used to produce the travel condition information DI. In the present example, in order for the notification system 2 to determine whether the probe vehicle 80 is in a wrong-way state, the travel information obtaining portion 21 obtains travel information including at least information on the travel direction as a direction in which the probe vehicle 80 travels with respect to the traffic lane/direction classification.

A road information obtaining portion 22 obtains road information from the road map database 12. In the present example, the road information obtaining portion 22 obtains from the road map database 12 the road information including at least information on the traffic lane/direction classification showing a designated travel direction of the road at the vehicle position located by the vehicle position locating portion 11 so that whether the probe vehicle 80 is in a wrong-way state is determined. The information on the traffic lane/direction classification which is obtained by the road information obtaining portion 22 is provided to a wrong-way state determining portion 23.

The wrong-way state determining portion 23 determines whether the travel state of the probe vehicle 80 is a wrong-way state, based on the road information, the travel information, and predetermined wrong-way determination conditions. For example, the wrong-way determination conditions are conditions that the travel direction of the probe vehicle 80 is opposite to the designated travel direction of the road, and the travel speed of the probe vehicle 80 is equal to or higher than a predetermined reference speed. In this case, the wrong-way state determining portion 23 determines whether the travel direction is a wrong-way direction, based on the information on the traffic lane/direction classification which is provided by the road information obtaining portion 22, and the information on the travel direction and the information on the travel speed which are provided by the travel information obtaining portion 21. It should be understood that only the condition that the travel direction of the probe vehicle 80 is opposite to the designated travel direction of the road may be used as the wrong-way determination conditions. In this case, the wrong-way state determining portion 23 determines whether the travel direction is a wrong-way direction or not, based on the information on the traffic lane/direction classification which is provided by the road information obtaining portion 22, and the information on the travel direction which is provided by the travel information obtaining portion 21.

A travel state information producing portion 24 produces the travel state information DI (the probe information PI) including the information showing that the probe vehicle 80 is in the wrong-way state. The travel state information DI thus produced is transmitted to a transmission control portion 44 (a travel state information transmitting portion) that transmits the travel state information DI to the distribution system 3. In order to be used in the navigation system 5, the produced travel state information DI is also transmitted to the traffic information obtaining portion 42. As long as the probe vehicle 80 is in the wrong-way state, the transmission control portion 44 continually transmits the information showing that the probe vehicle 80 is in the wrong-way state, every time predetermined notification conditions are satisfied. The notification conditions can be, e.g., every time when predetermined time has elapsed or every time when a predetermined distance has been traveled after the first notification.

If the probe vehicle 80 in the wrong-way state (the wrong-way vehicle) turns off a highway at an interchange onto a local road, enters a rest area or a parking area, or is stopped in the rest area or the parking area, the probe vehicle 80 is no longer in the wrong-way state on a traveling lane of the highway, or detection of wrong-way traveling is terminated. In this case, the travel state information DI indicating that notification of the wrong-way state is terminated is transmitted to the distribution system 3.

Every time the "notification conditions" as described above are satisfied, the transmission control portion 44 transmits the travel state information DI via a communication module 58 having an antenna, a modulation circuit, etc., which are not shown. The communication module 58 functions both as a transmitter that transmits the travel state information DI, and as a receiver that receives the traffic information TI distributed by the distribution system 3. That is, the communication module 58 receives the traffic information TI, etc. that is transmitted from the distribution system 3, and transmits the received information to a reception control portion 41. The reception control portion 41 receives the traffic information TI and the travel state information DI transmitted from another vehicle via the communication module 58.

The probe information PI (the travel state information DI) transmitted from the communication module 58 of the probe vehicle 80 is received by a reception control portion 34 (a travel state information receiving portion) of the distribution system 3 via a communication module 78 of the control center 70. The communication module 78 of the control center 70 also functions both as a receiver that receives the probe information PI and request information REQ described below, and as a transmitter that transmits the traffic information TI. The probe information PI (the travel state information DI) received by the reception control portion 34 via the communication module 78 is stored in a traffic information database 36 (a traffic information DB). The distribution system 3 includes a road section database 35 (a road section DB) including road map data similar to that of the navigation system 5. As described below, the distribution system 3 distributes the traffic information TI by using information included in the traffic information database 36 and the road section database 35.

Figure 4:
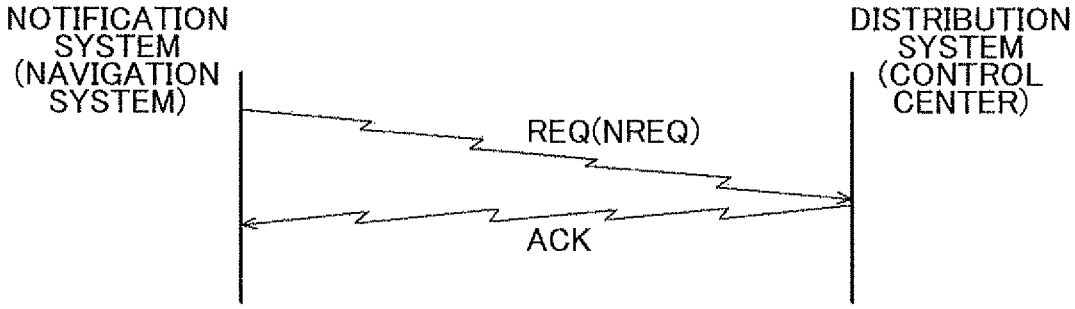
FIG. 4 is a diagram showing handshake communication between a notification system and a distribution system.

A communication mode between the notification system 2 and the distribution system 3 and a communication mode between the receiving system 4 and the distribution system 3 in the traffic information system 1 of the present example will be described. In the present example, both the communication mode between the notification system 2 and the distribution system 3 and the communication mode between the receiving system 4 and the distribution system 3 are a handshake communication mode. For example, as shown in FIG. 4, the notification system 2 that has produced the probe information PI transmits the probe information PI (the travel state information DI) and notification request information NREQ (the request information REQ) to the distribution system 3. The distribution system 3 receives the transmitted probe information. PI, and transmits back to the notification system 2 acknowledge information ACK acknowledging the probe information PI. Notification of the probe information PI need not necessarily be performed by the handshake communication, but may be performed by push communication that does not involve transmission of the acknowledge information ACK. However, in a case where the handshake communication is used, the notification system 2 can determine that the probe information PI is not correctly transmitted and can transmit the probe information PI again, if no acknowledge information ACK is transmitted (if the notification system 2 fails to receive the acknowledge information ACK within a predetermined time).

Figure 5:
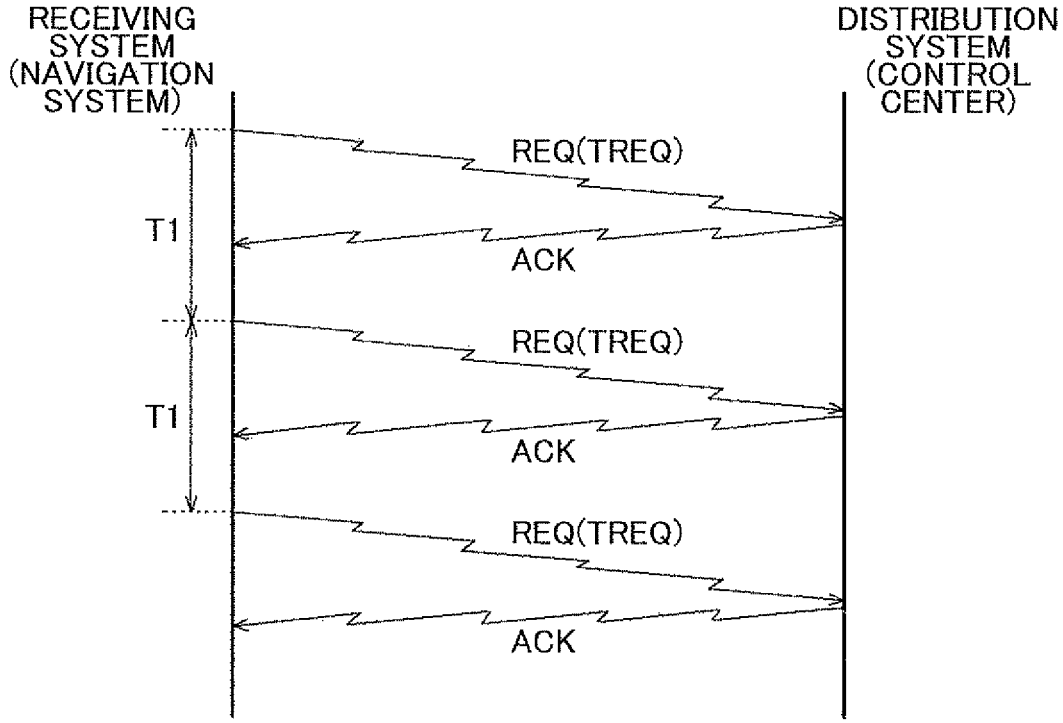
FIG. 5 is a diagram showing handshake communication between a receiving system and the distribution system.

Similarly, as shown in, e.g., FIG. 5, the receiving system 4 requesting to obtain the traffic information TI transmits to the distribution system 3 distribution request information TREQ (the request information REQ) requesting distribution (transmission) of the traffic information TI. The distribution request information TREQ includes the type of traffic information TI that is requested to be distributed, such as information on the wrong-way vehicle, information on the road condition. The distribution system 3 transmits to the receiving system 4 the acknowledge information ACK that includes the traffic information TI including the type of information specified by the distribution request information TREQ. In this case, if the specified type of information is not present in the traffic information database 36, null data (NULL) is produced as the traffic information TI, and the acknowledge information ACK including both command information indicating acknowledgement of the request information REQ and the traffic information TI (NULL) is transmitted to the receiving system 4. For example, the receiving system 4 repeatedly transmits the distribution request information TREQ at predetermined transmission intervals T1. It should be understood that the distribution system 3 may distribute the traffic information TI regardless of whether the distribution request information TREQ is transmitted from the receiving system 4.

Next, traffic information distribution method will be described with reference to the processing algorithm shown in FIGS. 6A and 6B. The process algorithm may be implemented in the form of computer program(s) that is/are stored in, for example, storage medium(s) in the distribution system 3 and/or receiving system 4, and executed by controller(s). Although the structure of the above-described distribution system 3 and/or receiving system 4 is referenced in the description of the process, the reference to such structure is exemplary, and the method need not be limited by the specific structure.

An example will be described with respect to an example in which "wrong-way vehicle information" is distributed as the traffic information TI. In the flowchart of FIGS. 6A and 6B, "#40" represents a series of processes in the receiving system 4, and "#30" represents a series of processes in the distribution system 3. As described above, in the present example, the distribution request information TREQ is first transmitted from the receiving system 4 to the distribution system 3 in the case of distributing the traffic information TI (#41: request information transmitting function/step). Specifically, in the target vehicle 90 having mounted thereon the receiving system 4 requesting wrong-way vehicle information, the transmission control portion 44 (a request signal transmitting portion) transmits the distribution request information TREQ to the reception control portion 34 (a request information receiving portion) of the distribution system 3. The reception control portion 34 of the distribution system 3 is ready to receive the distribution request information TREQ (#31). If the distribution request information TREQ is transmitted from the receiving system 4, the reception control portion 34 of the distribution system 3 receives the distribution request information TREQ (#32: request information receiving function/step). The reception control portion 34 of the distribution system 3 functions as the request information receiving portion that receives the distribution request information together with target vehicle position information.

In response to the distribution request information TREQ, an acknowledge information producing portion 33 (a traffic information producing portion) and a reporting range determining portion 32 of the distribution system 3 obtain the wrong-way vehicle information from the traffic information database 36 (#33: wrong-way vehicle information obtaining function/step). The distribution request information TREQ includes vehicle position information (target vehicle position information) of the target vehicle 90 having the receiving system 4 mounted thereon, information on the road on which the target vehicle 90 is traveling, etc. Based on, e.g., such information included in the distribution request information TREQ, the acknowledge information producing portion 33 and the reporting range determining portion 32 obtain information on any wrong-way vehicle (probe vehicle 80) that is present near the target vehicle position or on the road on which the target vehicle 90 is traveling. If there is no wrong-way vehicle, or if no wrong-way vehicle information that matches the conditions is present in the traffic information database 36, the acknowledge information producing portion 33 produces null data (NULL) as the traffic information TI. A transmission control portion 31 (a traffic information distributing portion/acknowledge information transmitting portion) of the distribution system 3 transmits, e.g., the acknowledge information ACK including both command information indicating acknowledgement of the request information REQ and the traffic information TI (NULL) to the receiving system 4 (#34, $1, #39*b*).

Figure 7:
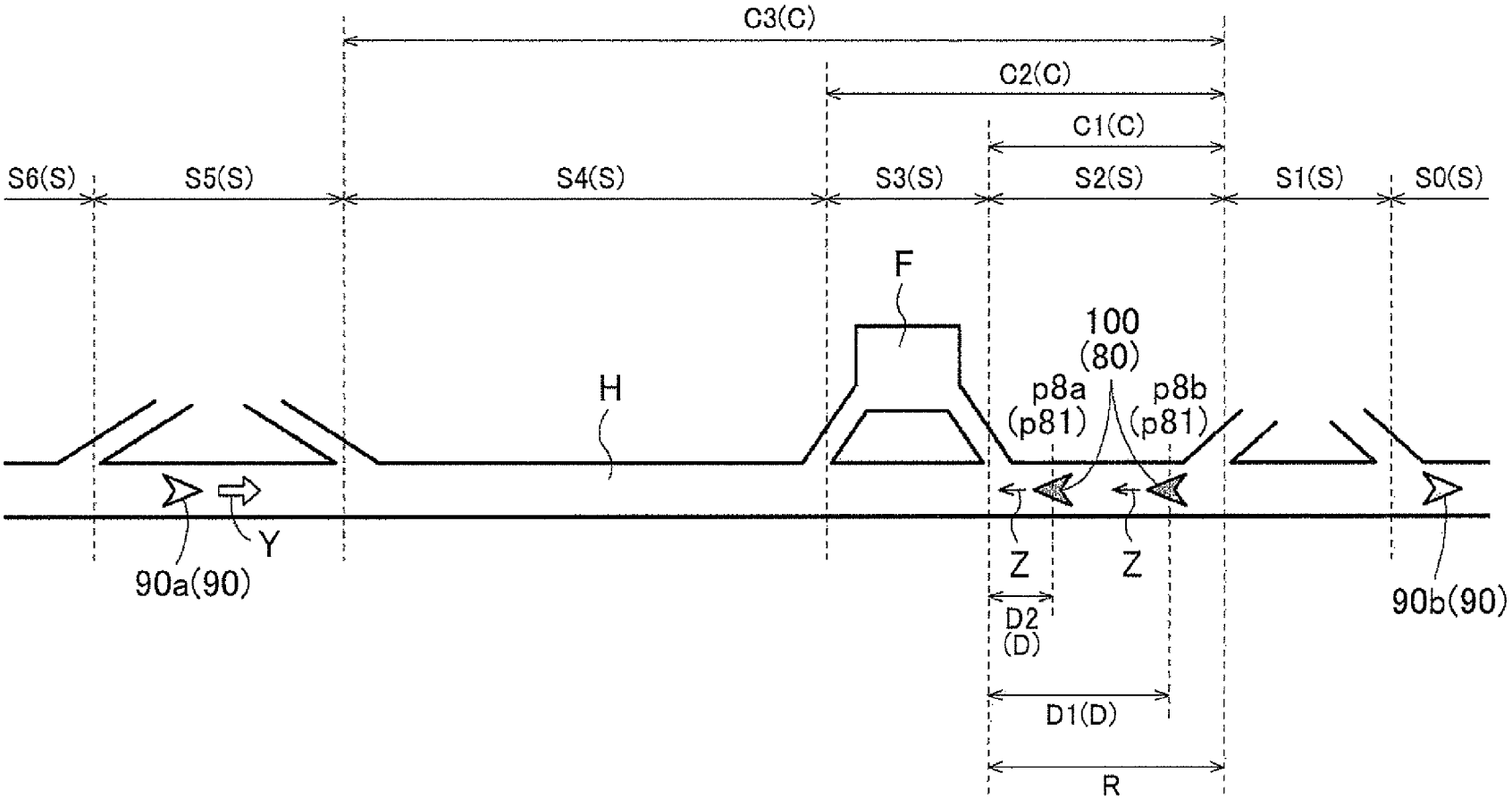
FIG. 7 is an illustration showing an example of a method for setting a reporting range.

On the other hand, if there is any wrong-way vehicle, that is, if appropriate wrong-way vehicle information is present in the traffic information database 36, the reporting range determining portion 32 obtains from the road section database 35 the information on a road section (a wrong-way section) where the wrong-way vehicle is present, based on the wrong-way vehicle information (#35: road section information obtaining function/step). As shown in FIG. 7, each road section S is set between two adjacent branch points on a road (a traveling lane H). In FIG. 7, the traveling lane H represents a traveling lane of a highway, and the reference character "F" represents a highway facility such as a rest area. A road connecting the rest area F and the traveling lane H is a connection road. Although highway facilities such as interchanges are not shown in FIG. 7, connection roads connecting the traveling lane H to interchanges, etc. are shown in FIG. 7.

It is preferable that when obtaining the information on the road section S where a wrong-way vehicle 100 is present (a wrong-way section R), the reporting range determining portion 32 also obtain the information on at least one road section S adjacent to the wrong-way section R in the direction in which the wrong-way vehicle 100 (e.g., the probe vehicle 80) travels (a wrong-way direction Z). For example, as shown in FIG. 7, if the wrong-way vehicle 100 is present in a road section S2, the road section S2 is the wrong-way section R. Thus, the reporting range determining portion 32 obtains at least the information on a road section S3 adjacent to the wrong-way section R (the road section S2) in the wrong-way direction Z. At this time, it is preferable that, depending on the conditions, the reporting range determining portion 32 further obtain the information on a road section S4 adjacent to the road section S3 in the wrong-way direction Z and a road section S5. In particular, if the road section S (in this example, the road section S3) adjacent to the wrong-way section R has a short length, it is preferable that the reporting range determining portion 32 further obtain the information on a road section S located ahead of the road section S adjacent to the wrong-way section R in the wrong-way direction Z (in this example, the road section S4, etc.).

After obtaining the information on the wrong-way section R, the reporting range determining portion 32 determines whether or not a distance D between end points (hereinafter referred to as the "end-point distance D"), which is a distance between an end point located on the wrong-way direction Z side of the wrong-way section R and a wrong-way vehicle detection position p81, is equal to or larger than a predetermined reference distance (#36: end-point distance determining function/step). If the end-point distance D is equal to or larger than the reference distance, the reporting range determining portion 32 sets the wrong-way section R as a reporting range C (#37*a* (#37): reporting range setting function/step). On the other hand, if the end-point distance D is less than the reference distance, the reporting range determining portion 32 sets the wrong-way section R and at least one road section S adjacent to the wrong-way section R in the wrong-way direction Z as the reporting range C (∩37*b* (#37): reporting range setting function/step). The functions/steps #36 and #37 or the functions/steps #34 to #37 correspond to the reporting range determining function/step that is performed by the reporting range determining portion 32.

Conditions of setting the reporting range C will be described with reference to FIG. 7. As described above, FIG. 7 shows an example in which the receiving system 4 mounted on the target vehicle 90 (90*a*) traveling on the traveling lane H of the highway as a road obtains the traffic information TI. The wrong-way vehicle 100 is traveling on the traveling lane H in the wrong-way direction Z that is opposite to a designated travel direction Y of the road (the traveling lane H). The wrong-way vehicle 100 is present in the road section S2, and thus the road section S2 is the wrong-way section R. As shown in FIG. 7, the wrong-way vehicle 100 is present on the travel direction Y side of the target vehicle 90 on the road. If the wrong-way vehicle detection position p81 is "p8*b*," the end-point distance D as the distance between the end point located on the wrong-way direction Z side of the wrong-way section R and the wrong-way vehicle detection position p81 is "D1" as shown in FIG. 7. On the other hand, if the wrong-way vehicle detection position p81 is "p8*a*," the end-point distance D is "D2," which is shorter than "D1," as shown in FIG. 7. That is, in the case where the wrong-way vehicle detection position p81 is "p8*a*," the wrong-way vehicle 100 may enter the subsequent road section S (in this case, the road section S3) from the wrong-way section R earlier than in the case where the wrong-way vehicle detection position p81 is "p8*b*." Thus, the reporting range determining portion 32 sets the reporting range C according to the end-point distance D.

It is herein assumed that the reference distance is a predetermined value that is shorter than "D1" and longer than "D2." If the wrong-way vehicle detection position p81 is "p8*b*," the end-point distance D is the reference distance or more. Thus, the reporting range C is set to "C1," which is the same range as the wrong-way section R. On the other hand, if the wrong-way vehicle detection position p81 is "p8*a*," the end-point distance D is less than the reference distance. Thus, the reporting range C is set to a range combining the wrong-way section R and at least one road section S adjacent to the wrong-way section R in the wrong-way direction Z. Most simply, the reporting range C is set to "C2," which is a range combining the wrong-way section R (the road section S2) and the road section S (S3) adjacent to the wrong-way section R in the wrong-way direction Z. Since each road section S is set between two adjacent branch points on the road (the traveling lane H), the road sections S vary in length. Accordingly, the distance between the wrong-way vehicle detection position p81 and the end point located on the wrong-way direction Z side of the range combining the wrong-way section R and the road section S adjacent to the wrong-way section R (a temporary reporting range) may still be less than the reference distance. In such a case, it is preferable that the reporting range C be set to the range further combining an additional road section S located ahead of the road section S adjacent to the wrong-way section R in the wrong-way direction Z. For example, as shown in FIG. 7, the reporting range C is set to "C3" which is the range combining the wrong-way section R (the road section S2) and two road sections S (S3, S4) adjacent to the wrong-way section R in the wrong-way direction.

In this example, the distance between the wrong-way vehicle detection position p81 and the end point located on the wrong-way direction Z side of the temporary reporting range is determined by using the same value as the reference distance that is used to determine the reporting range. However, it is to be understood that the distance may be determined by using a value different from the reference distance as a reference. The above description shows an example in which the reference distance used to determine the reporting range has a fixed value. However, the reference distance may be a variable value that varies according to the travel speed of the wrong-way vehicle 100, etc. Similarly, the value used to determine the temporary reporting range is not limited to a fixed value, and may be a variable value.

If the reporting range C is determined in this manner, the transmission control portion 31 (the traffic information distributing portion) determines whether the target vehicle position is in the reporting range C, based on the target vehicle position information included in the distribution request information TREQ (#38: acknowledge condition determining function/step). If the target vehicle position is in the reporting range C, the transmission control portion 31 transmits the acknowledge information ACK including the traffic information TI including the type of information designated by the distribution request information TREQ (in this case, the wrong-way vehicle information) to the receiving system 4 (#39*a* (#39): traffic information distributing function/step). On the other hand, if the target vehicle position is not in the reporting range C, the transmission control portion 31 produces null data (NULL) as the traffic information TI, and transmits the acknowledge information ACK including both the command information indicating acknowledgement of the distribution request information TREQ and the traffic information TI (NULL) to the receiving system 4 (#39*b* (#39): traffic information distributing function/step). The function/steps #38 and #39 may be the traffic information distributing function/step.

For example, the acknowledge information ACK including the traffic information TI is transmitted in the case where the distribution system 3 acknowledges the distribution request information TREQ from the target vehicle 90*a* shown in FIG. 7 (the target vehicle 90 that is traveling behind the wrong-way vehicle 100 in the travel direction Y). On the other hand, the acknowledge information ACK including both the command information indicating acknowledgement of the distribution request information TREQ and the traffic information TI (NULL) is transmitted in the case where the distribution system 3 acknowledges the distribution request information TREQ from a target vehicle 90*b* that is traveling ahead of the wrong-way vehicle 100 in the travel direction Y. That is, no wrong-way vehicle information is distributed to the target vehicle 90 if no caution about the presence of the wrong-way vehicle 100 need be sent to the user of that target vehicle 90

(in this example, the target vehicle 90*b*). This is preferable because the caution is not unnecessarily sent to the target vehicle 90*b*.

After transmitting the distribution request information TREQ, the receiving system 4 waits to receive the acknowledge information ACK from the distribution system 3 (#42). When the acknowledge information ACK is transmitted from the distribution system 3, the reception control portion 41 (the traffic information receiving portion) of the target vehicle 90 receives this acknowledge information ACK (#43: traffic information receiving function/step). If the traffic information TI (the wrong-way vehicle information) is included in the acknowledge information ACK, this information is transmitted to the route guidance computing portion 61 (the reporting portion) via the traffic information obtaining portion 42. In response to the traffic information TI, the route guidance computing portion 61 (the reporting portion) sends the caution for the user (occupant) of the target vehicle 90, based on this traffic information TI (#44, #48: reporting function/step). For example, the route guidance computing portion 61 warns the user against the presence of the wrong-way vehicle 100. If the traffic information TI is null data (NULL), the route guidance computing portion 61 terminates the processing without sending the caution, based on the null data (#44).

Figure 6A:
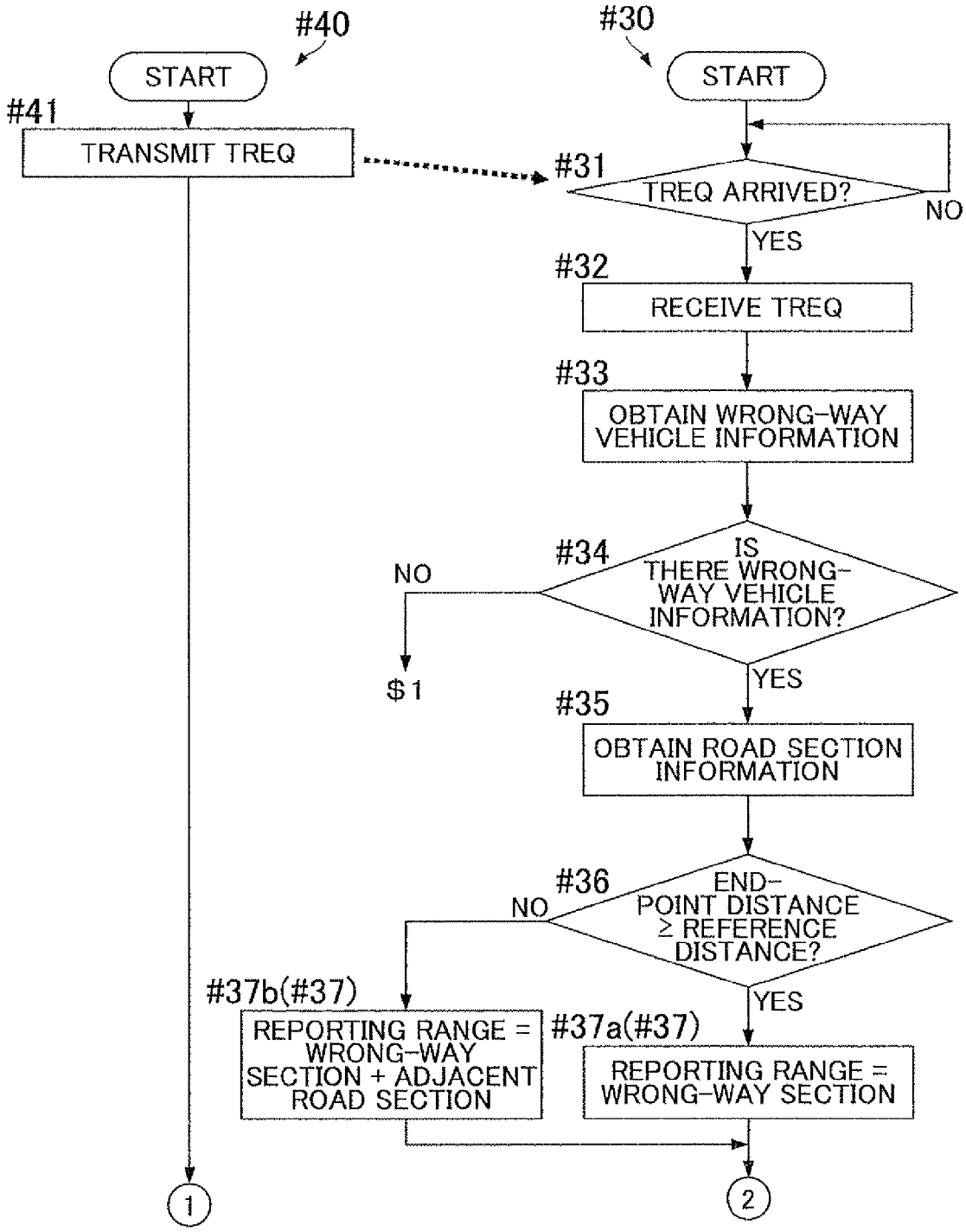
FIG. 6A and FIG. 6B are a flowchart showing an algorithm in which traffic information is distributed in response to distribution request information.
Figure 6B:
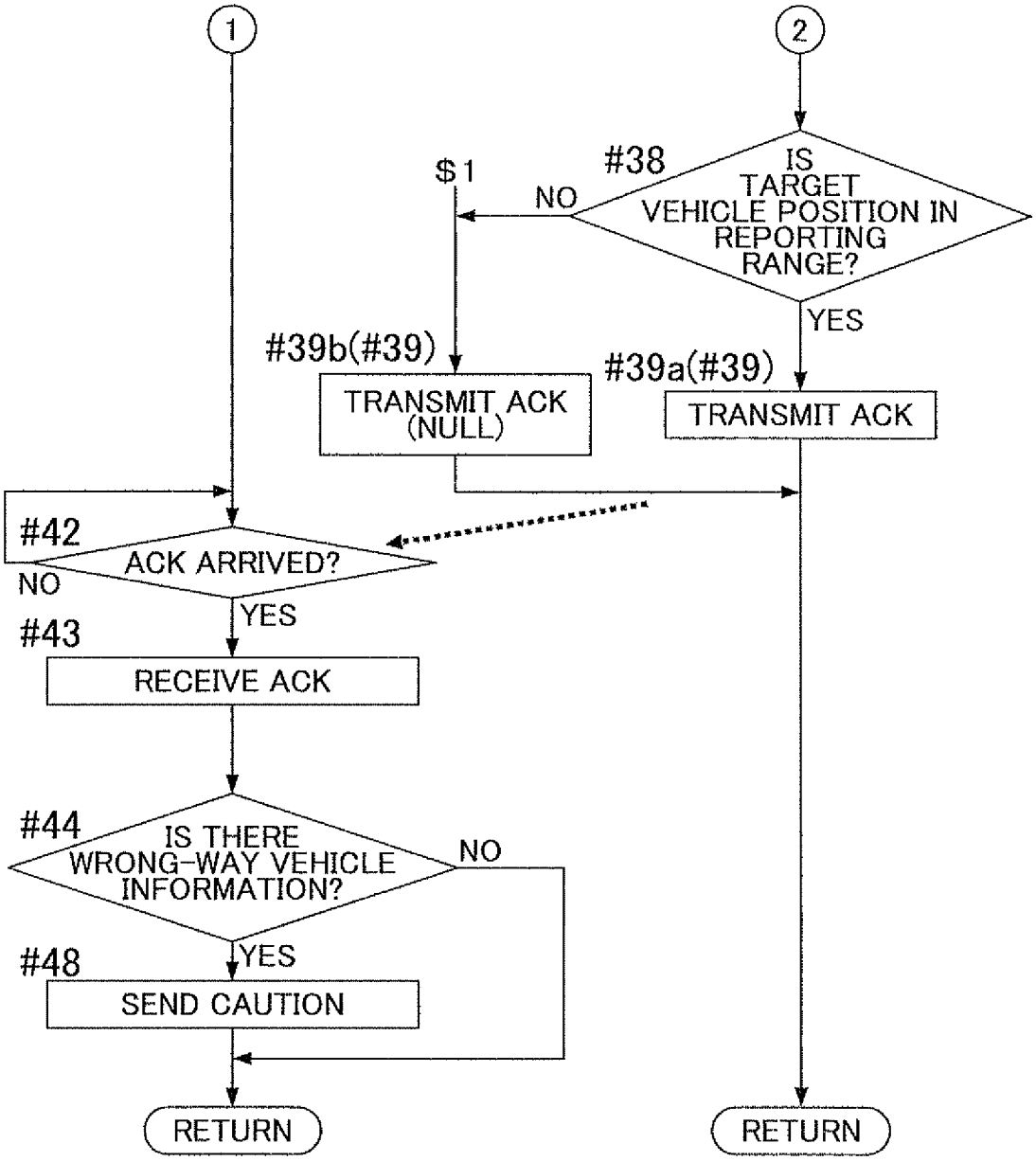

The above example described with reference to FIGS. 6A and 6B shows an example in which the distribution system 3 selects the target vehicle 90 according to the reporting range C and distributes the traffic information TI to the selected target vehicle 90. However, the transmission control portion 31 (the traffic information distributing portion) need only transmit the traffic information TI so that the target vehicle 90 present in the reporting range C is provided with the wrong-way vehicle information. That is, the transmission control portion 31 (the traffic information distributing portion) need only be able to transmit the traffic information TI so that the caution based on the wrong-way vehicle information is sent to the user if the target vehicle 90 having the receiving system 4 mounted thereon is present in the reporting range C, and that the caution based on the wrong-way vehicle information is not sent to the user if the target vehicle 90 is not present in the reporting range C.

Figure 8A:
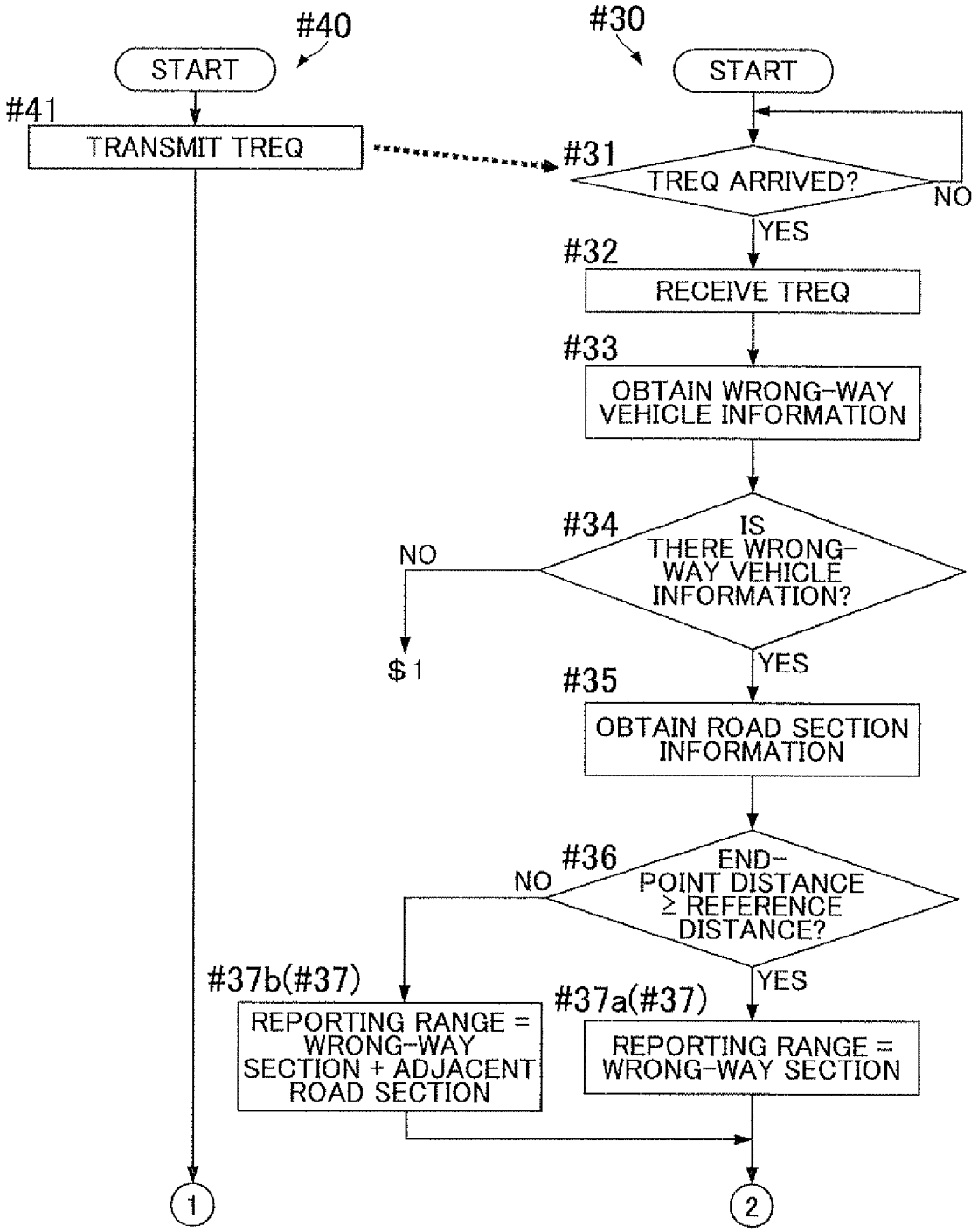
FIGS. 8A and 8B are a flowchart showing another algorithm in which traffic information is distributed in response to distribution request information.
Figure 8B:
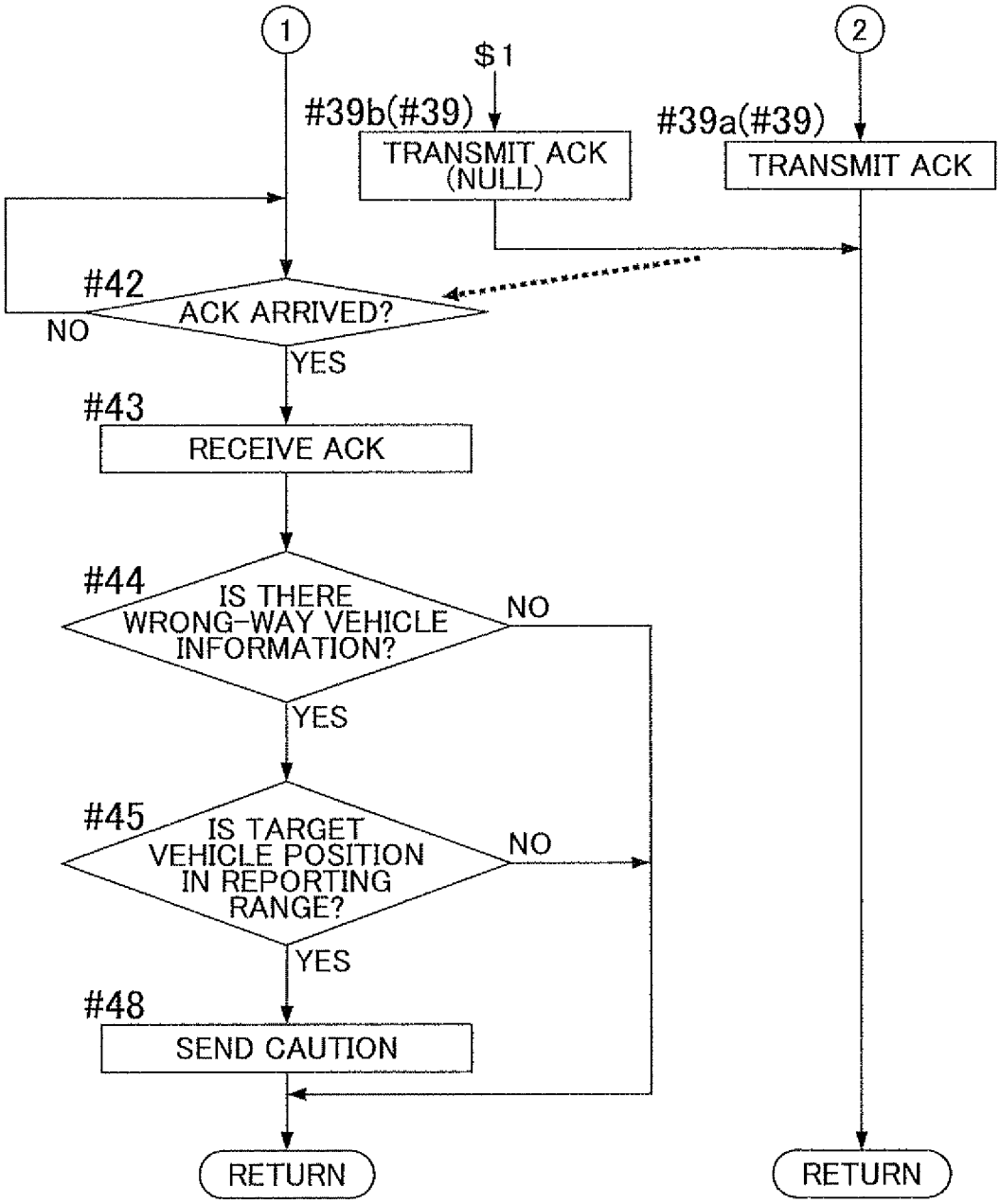

Next, traffic information distribution method will be described with reference to the processing algorithm shown in FIGS. 8A and 8B. The process algorithm may be implemented in the form of computer program(s) that is/are stored in, for example, storage medium(s) in the distribution system 3 and/or receiving system 4, and executed by controller(s). Although the structure of the above-described distribution system 3 and/or receiving system 4 is referenced in the description of the process, the reference to such structure is exemplary, and the method need not be limited by the specific structure.

In the present example, the distribution system 3 does not select the target vehicle 90 according to the reporting range C, but distributes acknowledge information ACK including reporting range information indicating the information range C. In response to this acknowledge information ACK, the receiving system 4 determines whether to send the caution to the user, based on the target vehicle position information of the target vehicle 90 and the reporting range information. In FIGS. 8A and 8B, functions/steps similar to those of FIGS. 6A and 613 are denoted with the same reference characters, and detailed description thereof will be omitted.

As in the flowchart of FIG. 6A, the distribution request information TREQ is transmitted from the receiving system 4 to the distribution system 3 (#41). In response to the distribution request information TREQ, the distribution system 3 sets the reporting range C in a manner similar to that of the flowchart of FIG. 6A (#32 to #37). Next, the distribution system 3 distributes acknowledge information ACK to the receiving system 4, without determining whether the target vehicle 90 having mounted therein the receiving system 4 that has transmitted the distribution request information TREQ is included in the reporting range C or not (#39: traffic information distributing function/step). If there is wrong-way vehicle information, at least the reporting range information showing the reporting range C, and the wrong-way vehicle information are included as the traffic information TI in this acknowledge information ACK.

As in the flowchart of FIG. 6B, after transmitting the distribution request information TREQ, the receiving system 4 waits to receive the acknowledge information ACK from the distribution system 3 (#42). When the acknowledge information ACK is transmitted from the distribution system 3, the reception control portion 41 of the target vehicle 90 receives this acknowledge information ACK (#43). If the traffic information TI included in the acknowledge information ACK is null data (NULL), the route guidance computing portion 61 terminates the processing without sending the caution (#44). On the other hand, if the traffic information TI is not null data (NULL), the traffic information TI including the reporting range information and the wrong-way vehicle information is transmitted to the route guidance computing portion 61 (the reporting portion) via the traffic information obtaining portion 42. The route guidance computing portion 61 determines whether the target vehicle position is in the reporting range C, based on the target vehicle position information and the reporting range information (#45). If the target vehicle position is in the reporting range C, the route guidance computing portion 61 warns the user against the presence of the wrong-way vehicle 100 (#48).

Figure 9:
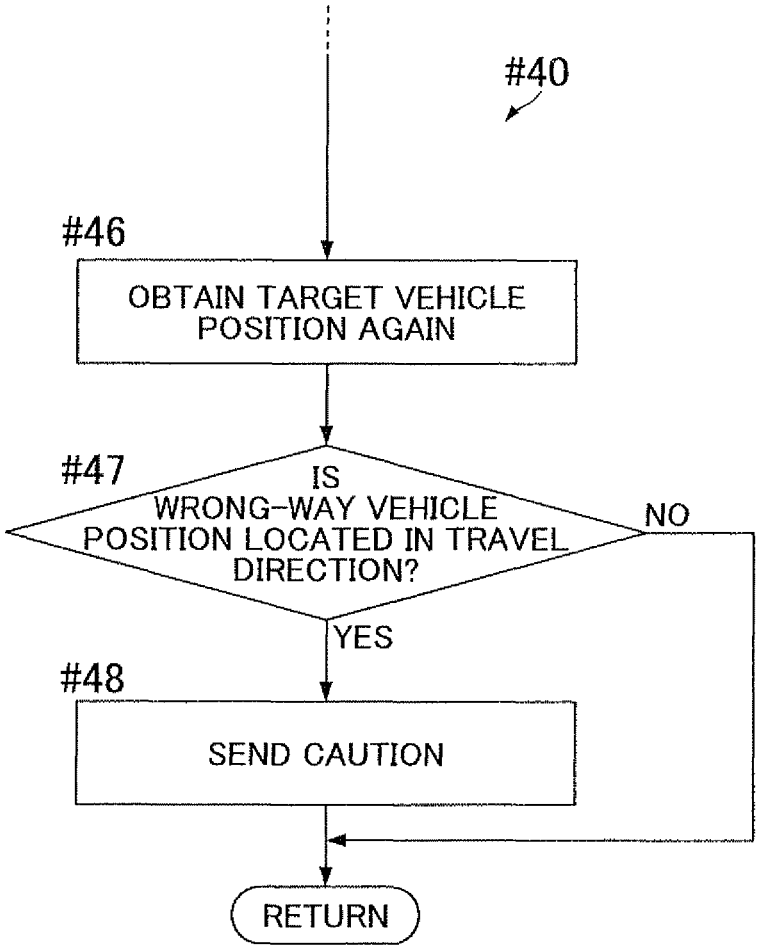
FIG. 9 is a flowchart showing an algorithm in which a caution is provided in the receiving system.

The target vehicle position of the target vehicle 90 changes even during handshake communication between the receiving system 4 and the distribution system 3 and during processing of the received acknowledge information in the receiving system 4. Accordingly, it is preferable that the target vehicle information be obtained again and the wrong-way vehicle detection position p81 is compared with the target vehicle position, e.g., immediately before the caution is sent (immediately before the function/step #48). That is, it is preferable that the route guidance computing portion 61 (the reporting portion) determine whether or not the wrong-way vehicle detection position p81 is located ahead of the target vehicle position in the designated travel direction of the road, and if it is determined that the wrong-way vehicle detection position p81 is located ahead of the target vehicle 90 in the travel direction, the route guidance computing portion 61 (the reporting portion) send the caution based on the wrong-way vehicle information. Specifically, it is preferable to perform the functions/steps #46 and #47 in FIG. 9 immediately before the function/step #48 in FIGS. 6B and 8B.

Figure 10A:
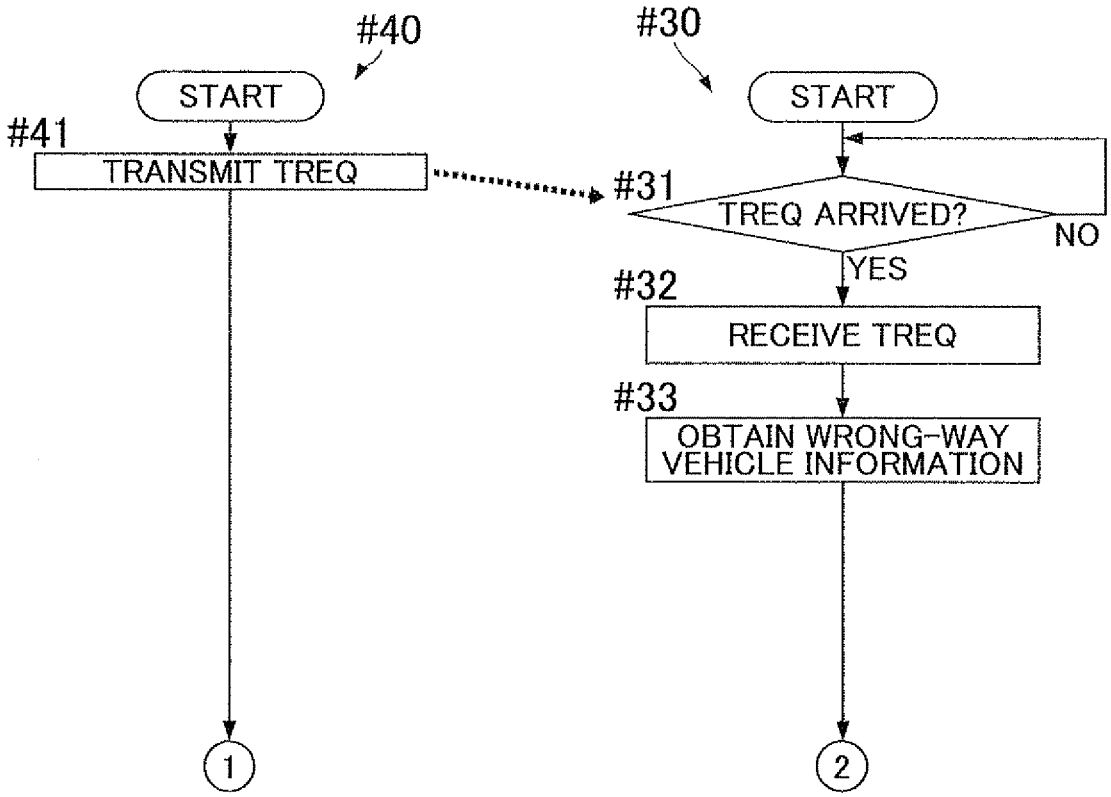
FIGS. 10A and 10B are a flowchart showing an algorithm of procedures of distribution and reception of wrong-vehicle information.
Figure 10B:
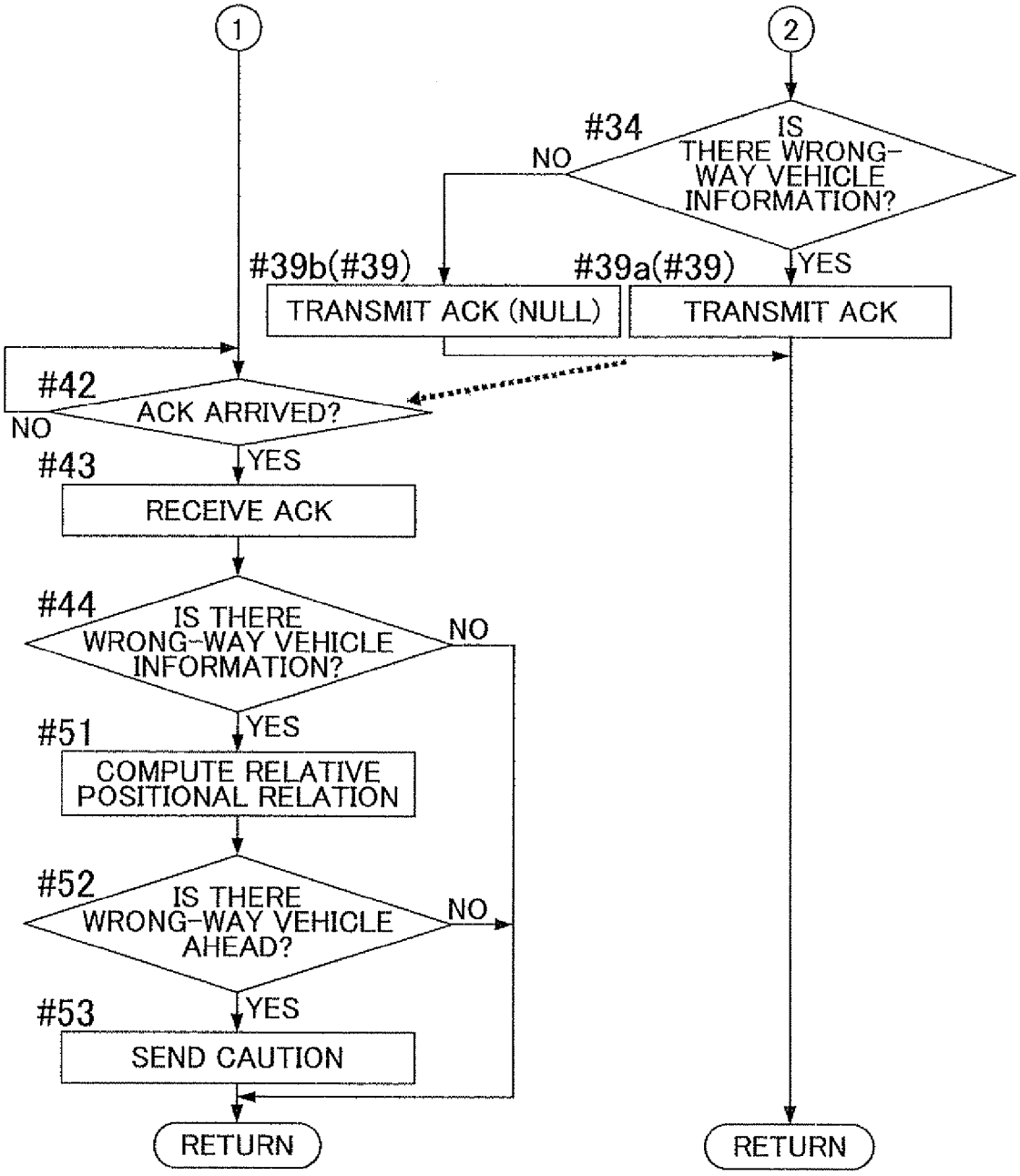

Next, traffic information distribution method will be described with reference to the processing algorithm shown in FIGS. 10A and 10B. The process algorithm may be implemented in the form of computer program(s) that is/are stored in, for example, storage medium(s) in the distribution system 3 and/or receiving system 4, and executed by controller(s). Although the structure of the above-described distribution system 3 and/or receiving system 4 is referenced in the description of the process, the reference to such structure is exemplary, and the method need not be limited by the specific structure.

In the example described in detail below, an example is described by using the flowchart of FIGS. 10A and 10B as well, in which the distribution system 3 transmits the traffic information TI in response to the distribution request information TREQ, and the receiving system 4 sends the caution in response to the traffic information TI (wrong-way vehicle information). This example will be described with respect to the case where the "wrong-way vehicle information" is distributed as the traffic information TI. In the flowchart of FIGS. 10A and 10B, "#40" represents a series of processes in the receiving system 4, and "#30" represents a series of processes in the distribution system 3.

As described above, in the present example, the distribution request information TREQ is first transmitted from the receiving system 4 to the distribution system 3 in the case of distributing the traffic information TI (#41: request information transmitting function/step). Specifically, in the target vehicle 90 having mounted thereon the receiving system 4 requesting the wrong-way vehicle information, the transmission control portion 44 transmits the distribution request information TREQ to the reception control portion 34 of the distribution system 3. In this case, it is preferable that the transmission control portion 44 transmit the distribution request information TREQ including the target vehicle position information. The transmission control portion 44 of the target vehicle 90 functions as a request information transmitting portion, and the reception control portion 34 of the distribution system 3 functions as a request information receiving portion. The reception control portion 34 of the distribution system 3 is ready to receive the distribution request information TREQ (#31). If the distribution request information TREQ is transmitted from the receiving system 4, the reception control portion 34 of the receiving system 4 receives the distribution request information TREQ (#32: request information receiving function/step).

In response to the distribution request information TREQ, the traffic information producing portion 33 (the acknowledge information producing portion) of the distribution system 3 obtains the wrong-way vehicle information from the traffic information database 36 (#33: wrong-way vehicle information obtaining function/step). The vehicle position information (the target vehicle position information) of the target vehicle 90 having the receiving system 4 mounted thereon, the information on the road on which the target vehicle 90 is traveling, etc. are included in the distribution request information TREQ. Based on, e.g., such information included in the distribution request information TREQ, the traffic information producing portion 33 obtains the information on any wrong-way vehicle (probe vehicle 80) that is present near the target vehicle position or on the road on which the target vehicle 90 is traveling. If there is any wrong-way vehicle, and wrong-way vehicle information that matches the conditions is present in the traffic information database 36, the traffic information producing portion 33 produces the acknowledge information ACK including the traffic information TI including the type of information designated in the distribution request information TREQ (in this example, the wrong-way vehicle information). That is, the traffic information producing portion 33 functions as the acknowledge information producing portion. The transmission control portion 31 transmits this acknowledge information ACK to the receiving system 4 (#39*a* (#39): traffic information distributing function/step). The transmission control portion 31 functions as a traffic information distributing portion and an acknowledge information transmitting portion.

On the other hand, if there is no wrong-way vehicle, or if no wrong-way vehicle information that matches the conditions is present in the traffic information database 36, the traffic information producing portion 33 produces null data (NULL) as the traffic information TI. The transmission control portion 31 of the distribution system 3 transmits, e.g., the acknowledge information ACK including both command information indicating acknowledgement of the request information REQ and the traffic information TI (NULL) to the receiving system 4 (#39*b* (#39)).

After transmitting the distribution request information TREQ, the receiving system 4 waits to receive the acknowledge information ACK from the distribution system 3 (#42). When the acknowledge information ACK is transmitted from the distribution system 3, the reception control portion 41 (the traffic information receiving portion) of the target vehicle 90 receives this acknowledge information ACK (#43: traffic information receiving function/step). If the traffic information TI (the wrong-way vehicle information) is included in the acknowledge information ACK, this information is transmitted to the route guidance computing portion 61 (the reporting portion) via the traffic information obtaining portion 42. In response to the traffic information TI, the route guidance computing portion 61 (the reporting portion) determines whether the wrong-way vehicle information is included in the traffic information I (#44). If the wrong-way vehicle information is included in the traffic information I, the route guidance computing portion 61 (the reporting portion) computes the relative positional relation between the target vehicle 90 and the wrong-way vehicle, based on the target vehicle position (#51: relative positional relation computing function/step).

Subsequently, the route guidance computing portion 61 (the reporting portion) determines whether the wrong-way vehicle 100 is present ahead of the target vehicle 90 (in the travel direction), based on the computed relative positional relation (#52: relative positional relation determining function/step). If it is determined that the wrong-way vehicle 100 is present ahead of the target vehicle 90, the route guidance computing portion 61 (the reporting portion) send the caution based on the wrong-way vehicle information (#53: caution sending function/step).

Figure 11:
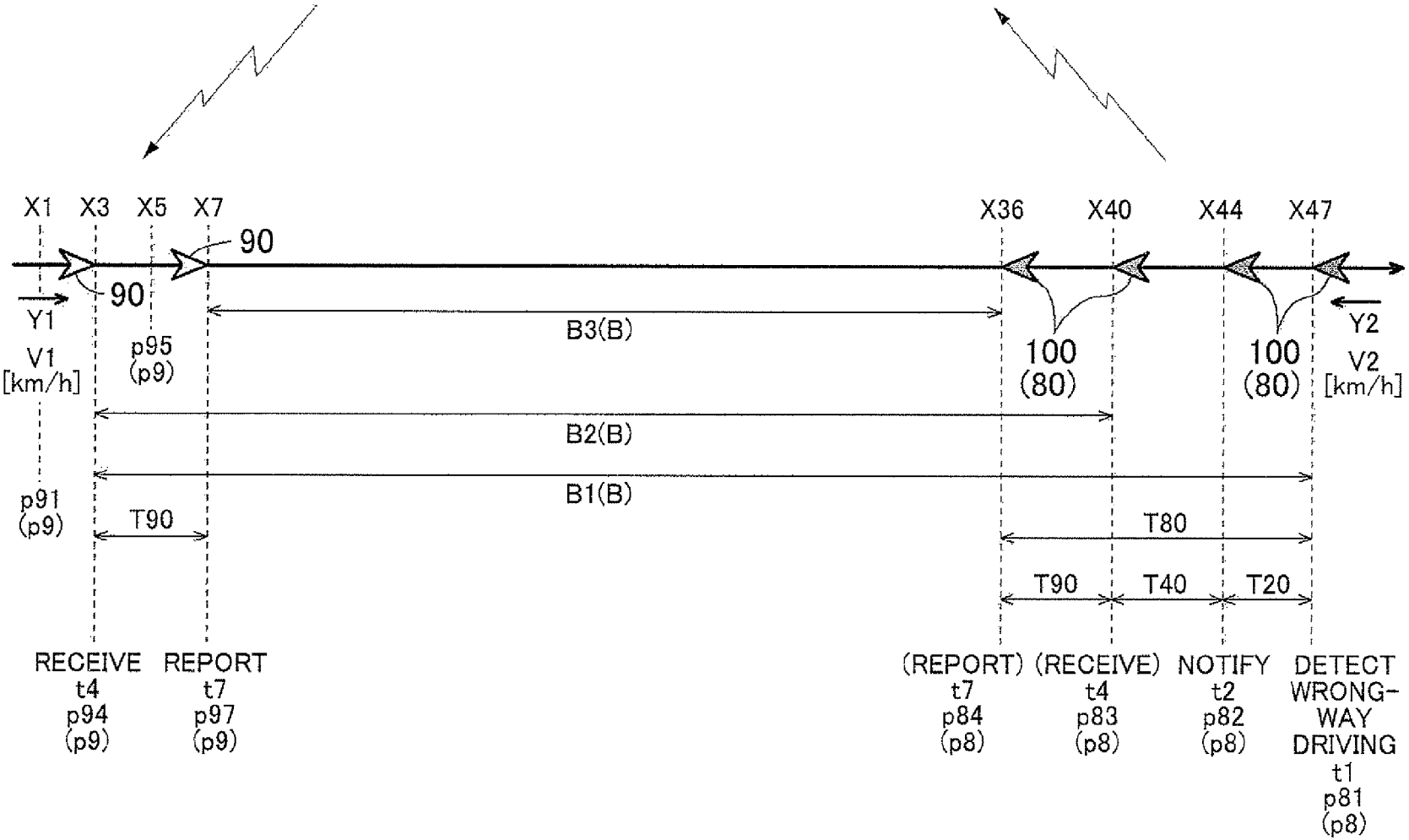
FIG. 11 is an illustration showing a manner in which the wrong-way vehicle information is used by the receiving system.

The relative positional relation will be described. FIG. 11 is a schematic diagram in which the road on which the target vehicle 90 travels is projected on a number line whose positive direction is the travel direction Y1 of the target vehicle 90. It is herein assumed that the wrong-way vehicle 100 is present on this number line. The "road on which the target vehicle 90 travels" includes a road (a target road) on which the target vehicle 90 travels, and a road (a connection road) connecting to the target road in the travel direction of the target vehicle 90. Thus, the road on which the target vehicle 90 travels is often not a straight line, and is often a collection of line segments having branches. However, for simple description of the relative positional relation, such branches (connection roads) are herein not considered, and the road on which the target vehicle 90 travels is described a single number line simulating a straight road.

In the schematic diagram of FIG. 11, it is detected at time "t1" that the probe vehicle 80 is in the wrong-way state. That is, the probe vehicle 80 is detected as the wrong-way vehicle 100, and its probe information PI including the wrong-way vehicle information is transmitted to the distribution system 3. The detection time included in the wrong-way vehicle information is "t1." As shown in FIG. 11, the wrong-way vehicle detection position p81, which represents the position of the wrong-way vehicle 100 at time t1, is given by coordinate X47 on the number line. The wrong-way vehicle speed, which represents the speed of the wrong-way vehicle 100 at detection time t1, is "V2 [km/h]."

The distribution system 3 distributes to the target vehicle 90 the wrong-way vehicle information received from the probe vehicle 80 (the wrong-way vehicle 100) as the notification system 2. The target vehicle 90 receives the wrong-way vehicle information at time t4 that is later than the detection time t1. As shown in FIG. 11, a target vehicle position p9 at time t4 is "p94," and is given by coordinate X3 on the number line. The receiving system 4 computes the relative positional relation between the target vehicle 90 and the wrong-way vehicle 100 based on the target vehicle position p9 and the wrong-way vehicle information. As an example, the relative positional relation between the target vehicle 90 and the wrong-way vehicle 100 can be computed based on "p94" as the target vehicle position p9 at time t4 and the wrong-way vehicle detection position p81 included in the wrong-way vehicle information. For example, as the relative positional relation, the relative distance B (B1) between these vehicles can be calculated as follows. B1=p81−p94=X47−X3=44X, where "X" is a base unit that represents the distance on the number line. Thus, in the case of using the number line whose positive direction is the travel direction of the target vehicle 90, it can be determined in step 452 in the flowchart of FIG. 10B that the wrong-way vehicle 100 is present ahead of the target vehicle 90, if the relative distance B has a positive value.

In the above example, the position "p94" at time t4 when the target vehicle 90 receives the wrong-way vehicle information is used as the target vehicle position p9 to compute the relative distance B. However, a position located before time t4, e.g., the position "p91" (coordinate X1) in FIG. 11, may be used as the target vehicle position p9. In this case, the relative distance B is "46X=X47−X1," which is calculated as if the target vehicle 90 is more separated from the wrong-way vehicle 100 than actually is. In view of the fact that the caution is sent so as to allow the target vehicle 90 to take more reliable evacuation actions, it is preferable that such a relative distance B have a small value (a conservative value). Accordingly, it is preferable that the relative positional relation (the relative distance B) be computed based on the target vehicle position p9 located by the vehicle position locating portion 11 after reception of the wrong-way vehicle information by the reception control portion 41 (the traffic information receiving portion) of the receiving system 4, for example, based on the position "p95 (coordinate X5)" in FIG. 11. In this case, the relative distance 13 is "42X=X47−X5." In the present example, as described above, the vehicle position locating portion 11 successively locates the vehicle position, and updates the information on the vehicle position. Accordingly, there is not a large difference between time t4 when the wrong-way vehicle information is received and the time when the target vehicle position p9 is specified. Thus, although the relative distance B tends to be decreased when computed by using the target vehicle position p9 located after reception of the wrong-way vehicle information, there is not a large difference between the relative distance B computed at time t4 and the relative distance B computed after reception of the wrong-way vehicle information.

By using the relative distance B, the target vehicle 90 can also calculate the arrival time, namely the time it takes until the target vehicle 90 and the wrong-way vehicle 100 become closest to each other. At least the wrong-way vehicle speed (V2) at the detection time t1 is obtained as the speed of the wrong-way vehicle 100. The target vehicle speed as the speed of the target vehicle 90 is obtained by the travel information obtaining portion 21 of the target vehicle 90 (V1 [km/h]). Thus, the relative speed V3 between the wrong-way vehicle 100 and the target vehicle 90 is "V3=V1+V2," and the arrival time can be calculated based on the relative speed V3 and the relative distance B (arrival time=B/V3).

As described above, in step #53 in the flowchart of FIG. 10B, "the distance between the wrong-way vehicle 100 and the target vehicle 90 (the host vehicle) (the relative distance B)" and "the time until the target vehicle 90 encounters the wrong-way vehicle 100 (the arrival time)" in addition to the "presence of the wrong-way vehicle 100 ahead" can be sent as the caution.

In fact, it takes a certain amount of time until the probe vehicle 80 produces the wrong-way vehicle information and transmits the produced wrong-way vehicle information to the distribution system 3 after detecting that the probe vehicle 80 itself is in the wrong-way state. Accordingly, the wrong-way vehicle information is actually transmitted to the distribution system 3 at time t2, which is after, e.g., a period T20 from the detection time t1. Moreover, it takes a certain amount of time until the target vehicle 90 (the receiving system 4) receives the wrong-way vehicle information after the distribution system 3 receives the information transmitted from the probe vehicle 80 and distributes the wrong-way vehicle information. For example, the target vehicle 90 receives the wrong-way vehicle information at time t4, which is after, e.g., a period T40 from the time t2 when the probe vehicle 80 transmits the wrong-way vehicle information. The wrong-way vehicle 100 keeps traveling in the wrong direction toward the target vehicle 90 during this period, namely the period from the detection time t1 to the time t4 (T20+T40). As shown in FIG. 11, at the time t2 after the period T20, the wrong-way vehicle position p8 is "p82 (coordinate X44)" that is closer to the target vehicle 90 than the wrong-way vehicle detection position p81. Moreover, at the time t4 after the period T40, the wrong-way vehicle position p8 is "p83 (coordinate X40)" that is closer to the target vehicle 90 than the wrong-way vehicle detection position p82. Accordingly, it is preferable to compute the relative distance B in view of the elapsed time from the detection time t1 to the time t4.

The detection time t1 is included in the wrong-way vehicle information. Since the time t4 is the time when the receiving system 4 has received the wrong-way vehicle information, the time t4 is known in the receiving system 4. Accordingly, the elapsed time from the detection time t1 to the time t4 (T20+T40) can be calculated as follows: T20+T40=t4−t1. Since the speed of the wrong-way vehicle 100 (the wrong-way vehicle speed) at the detection time (t1) is "V2" as described above, the travel distance of the wrong-way vehicle 100 during this period can be calculated as follows: travel distance=(T20+T40)×V2. As described below, the relative distance B is "B2," which is shorter than "B1" by this travel distance (see FIG. 11). Since the coordinate of "p83" as the wrong-way vehicle position p8 at the time t4 is "X40," "B2=37X=X40−X3."

The above description shows an example in which the relative positional relation is computed in view of the elapsed time from the detection time t1 when the wrong-way state is detected until the target vehicle 90 receives the wrong-way information. However, the target vehicle 90 (the receiving system 4) performs information processing computation during the period from reception of the wrong-way vehicle information to actual reporting of the information as the caution. Accordingly, for improved accuracy, it is preferable to compute the relative positional relation in view of the computation time (T90) in the target vehicle 90 as well. The time from reception of the wrong-way vehicle information until the reception of the wrong-way vehicle information is reported as the caution can be set as a constant according to the number of steps of a program, etc. Thus, the target vehicle 90 can set the time after the time as a constant (the predetermined computation time T90) from the time (t4) when the target vehicle 90 receives the wrong-way vehicle information, as scheduled report time t7. The scheduled report time t7 may be set to the time after the predetermined computation time T90 from the time (t4) when the target vehicle 90 receives the wrong-way vehicle information, or may be set to the time after the predetermined computation time T90 from the time corresponding to the located target vehicle position p9. The target vehicle 90 can compute the relative positional relation (the relative distance B) between both vehicles, based on the distance by which the wrong-way vehicle 100 moves from the wrong-way vehicle detection position p81 during the time (T80) from the detection time t1 to the scheduled report time t7, and the target vehicle position p9 at the scheduled report time t7 (a predicted target vehicle position p97).

"p84," which is the wrong-way vehicle position p8 of the wrong-way vehicle 100 at the scheduled report time t7, can be computed as follows: p84=p81−T80×V2=X47−(t7−t1)×V2−X36. If the target vehicle position p9 at the time t4 is located as "p94," the predicted target vehicle position p97, which is the target vehicle position p9 at the scheduled report time t7, can be computed as follows: p97=p94+T90×V1−X3+(t7−t4)×V1=X7. Accordingly, "B3," which is the relative distance B at the scheduled report time t7, can be calculated as follows. B3=p84−p97=X36−X7=29X. It should be understood that the time it takes until both vehicles become closest to each other from the scheduled report time t7 can also be computed based on the relative distance B (B3) and the relative speed V3.

Figure 12:
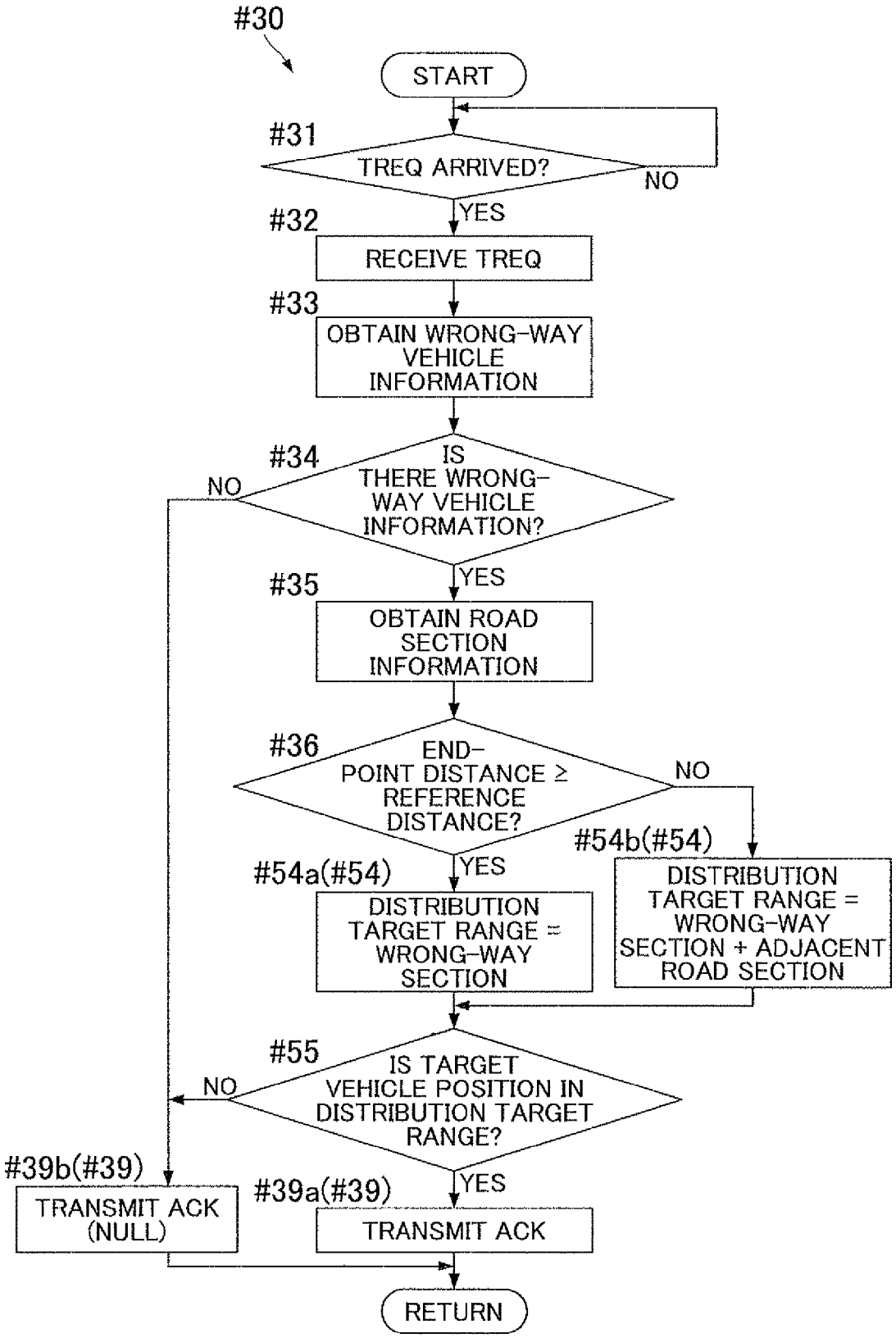
FIG. 12 is a flowchart showing an algorithm of the procedures of distribution by the distribution system.

Unnecessary computation in such a target vehicle 90 that need not take the presence of the wrong-way vehicle 100 into consideration can be suppressed by narrowing the distribution target range of the wrong-way vehicle information, namely the range in which the wrong-way vehicle information is to be distributed, to some degree by the distribution system 3. FIG. 12 shows only the processing #30 of the distribution system 3 in the flowchart of FIGS. 10A and 10B, and steps of narrowing the distribution target range of the wrong-way vehicle information (#35 to #54) have been added to the processing #30. Since steps #31 to #34 and #39 are as described above based on FIGS. 10A and 10B, detailed description thereof will be omitted.

If it is determined in step #34 that the wrong-way vehicle 100 is present, namely if appropriate wrong-way vehicle information is present in the traffic information database 36, a distribution target range determining portion 32 (see FIG. 3B) of the distribution system 3 obtains information on the road section where the wrong-way vehicle is present (the wrong-way section) from the road section database 35, based on the wrong-way vehicle information (#35: road section information obtaining function/step). As shown in FIG. 7, each road section S is set between two adjacent branch points on the road (the traveling lane H). In FIG. 7, the traveling lane H represents a traveling lane of a highway, and the reference character "F" represents a highway facility such as a rest area. A road connecting the rest area F and the traveling lane H is a connection road. Although highway facilities such as interchanges are not shown in FIG. 7, connection roads connecting the traveling lane H to interchanges, etc. are shown in FIG. 7.

It is preferable that when obtaining the information on the road section S where the wrong-way vehicle 100 is present (a wrong-way section R), the distribution target range determining portion 32 also obtain the information on at least one road section S adjacent to the wrong-way section R in the direction in which the wrong-way vehicle 100 (e.g., the probe vehicle 80) travels (the wrong-way direction Z). For example, as shown in FIG. 7, if the wrong-way vehicle 100 is present in the road section 52, the road section S2 is the wrong-way section R. Thus, the distribution target range determining portion 32 obtains at least the information on the road section S3 adjacent to the wrong-way section R (the road section S2) in the wrong-way direction Z. At this time, it is preferable that, depending on the conditions, the distribution target range determining portion 32 further obtain the information on the road section S4 adjacent to the road section S3 in the wrong-way direction Z and the road section S5. In particular, if the road section S adjacent to the wrong-way section R (in this example, the road section S3) has a short length, it is preferable that the distribution target range determining portion 32 further obtain the information a road section S located ahead of the road section S adjacent to the wrong-way section R in the wrong-way direction Z (in this example, the road section S4, etc.).

After obtaining the information on the wrong-way section R, the distribution target range determining portion 32 determines whether or not the end-point distance D, which is a distance between the end point located on the wrong-way direction Z side of the wrong-way section R and the wrong-way vehicle detection position p81, is equal to or larger than a predetermined reference distance (#36: end-point distance determining function/step). If the end-point distance D is equal to or larger than the reference distance, the distribution target range determining portion 32 sets the wrong-way section R as a distribution target range C (#54*a* (#54): distribution target range setting function/step). On the other hand, if the end-point distance D is less than the reference distance, the distribution target range determining portion 32 sets the wrong-way section R and at least one road section S adjacent to the wrong-way section R in the wrong-way direction Z as the distribution target range C (#54*b* (#54): distribution target range setting function/step). The functions/steps #36 and #54 or the functions/steps #34 to #54 correspond to the distribution target range determining function/step that is performed by the distribution target range determining portion 32.

Conditions of setting the distribution target range C will be described with reference to FIG. 7. As described above, FIG. 7 shows an example in which the receiving system 4 mounted on the target vehicle 90 (90*a*) traveling on the traveling lane H of the highway as a road obtains the traffic information TI. The wrong-way vehicle 100 is traveling on the traveling lane H in the wrong-way direction Z that is opposite to the designated travel direction Y of the road (the traveling lane H). The wrong-way vehicle 100 is present in the road section S2, and thus the road section S2 is the wrong-way section R. As shown in FIG. 7, the wrong-way vehicle 100 is present on the travel direction Y side of the target vehicle 90 on the road. If the wrong-way vehicle detection position p81 is "p8*b*," the end-point distance D as the distance between the end point located on the wrong-way direction Z side of the wrong-way section R and the wrong-way vehicle detection position p81 is "D1" as shown in FIG. 7. On the other hand, if the wrong-way vehicle detection position p81 is "p8*a*," the end-point distance D is "D2," which is shorter than "D1," as shown in FIG. 7. That is, in the case where the wrong-way vehicle detection position p81 is "p8*a*," the wrong-way vehicle 100 may enter the subsequent road section S (in this ease, the road section S3) from the wrong-way section R earlier than in the case where the wrong-way vehicle detection position p81 is "p8*b*." Thus, the distribution target range determining portion 32 sets the distribution target range C according to the end-point distance D.

It is herein assumed that the reference distance is a predetermined value that is shorter than "D1" and longer than "D2." If the wrong-way vehicle detection position p81 is "p8*b*," the end-point distance D is the reference distance or more. Thus, the distribution target range C is set to "C1," which is the same range as the wrong-way section R. On the other hand, if the wrong-way vehicle detection position p81 is "p8*a*," the end-point distance D is less than the reference distance. Thus, the distribution target range C is set to a range combining the wrong-way section R and at least one road section S adjacent to the wrong-way section R in the wrong-way direction Z. Most simply, the distribution target range C is set to "C2," which is a range combining the wrong-way section R (the road section S2) and the road section S (S3) adjacent to the wrong-way section R in the wrong-way direction Z. Since each road section S is set between two adjacent branch points on the road (the traveling lane H), the road sections S vary in length. Accordingly, the distance between the wrong-way vehicle detection position p81 and the end point located on the wrong-way direction Z side of the range combining the wrong-way section R and the road section S adjacent to the wrong-way section R (a temporary distribution target range) may still be less than the reference distance. In such a case, it is preferable that the distribution target range C be set to the range further combining an additional road section S located ahead of the road section S adjacent to the wrong-way section R in the wrong-way direction Z. For example, as shown in FIG. 7, the distribution target range C is set to "C3" which is the range combining the wrong-way section R (the road section S2) and two road sections S (S3, S4) adjacent to the wrong-way section R in the wrong-way direction.

In this example, the distance between the wrong-way vehicle detection position p81 and the end point located on the wrong-way direction Z side of the temporary distribution target range is determined by using the same value as the reference distance that is used to determine the distribution target range. However, it is to be understood that the distance may be determined by using a value different from the reference distance as a reference. The above description shows an example in which the reference distance used to determine the distribution target range has a fixed value. However, the reference distance may be a variable value that varies according to the travel speed of the wrong-way vehicle 100, etc. Similarly, the value used to determine the temporary distribution target range is not limited to a fixed value, and may be a variable value.

The distribution target range C may be set without performing such computation. Namely, the road section S having at least a portion included in a predetermined reference range on the wrong-way direction Z side of the wrong-way vehicle detection position p81 may be set as the distribution target range C. The "reference distance" described above is also a concept corresponding to this "reference range."

If the distribution target range C is determined in this manner, the transmission control portion 31 (the traffic information distributing portion) determines whether the target vehicle position is in the distribution target range C, based on the target vehicle position information included in the distribution request information TREQ (#55: acknowledge condition determining function/step). If the target vehicle position is in the distribution target range C, the transmission control portion 31 transmits the acknowledge information ACK including the traffic information TI including the type of information designated by the distribution request information TREQ (in this case, the wrong-way vehicle information) to the receiving system 4 (#39*a* (#39): traffic information distributing function/step). On the other hand, if the target vehicle position is not in the distribution target range C, the transmission control portion 31 produces null data (NULL) as the traffic information TI, and transmits the acknowledge information ACK including both the command information indicating acknowledgement of the distribution request information TREQ and the traffic information TI (NULL) to the receiving system 4 (#39*b* (#39): traffic information distributing function/step). The function/steps #55 and #39 may be the traffic information distributing function/step.

For example, the acknowledge information ACK including the traffic information TI is transmitted in the case where the distribution system 3 acknowledges the distribution request information TREQ from the target vehicle 90*a* shown in FIG. 7 (the target vehicle 90 that is traveling behind the wrong-way vehicle 100 in the travel direction Y). On the other hand, the acknowledge information ACK including both the command information indicating acknowledgement of the distribution request information TREQ and the traffic information TI (NULL) is transmitted in the case where the distribution system 3 acknowledges the distribution request information TREQ from a target vehicle 90*b* that is traveling ahead of the wrong-way vehicle 100 in the travel direction Y. That is, no wrong-way vehicle information is distributed to the target vehicle 90 if no caution about the presence of the wrong-way vehicle 100 need be sent to the user of that target vehicle 90 (in this example, the target vehicle 90*b*). This is preferable because the caution is not unnecessarily sent to the target vehicle 90*b*.

Narrowing the distribution target range in this manner can suppress an increase in the amount of communication due to distribution of unnecessary wrong-way vehicle information, and thus can suppress an increase in load on communication networks. There is a high possibility that information contained in road map information that is used in common navigation systems (e.g., information on links each representing a road between connection points), etc. can be used as the road sections. Moreover, the road sections are highly compatible with such road map information. Thus, the distribution system 3 can determine the distribution target range with very light computation load. That is, an increase in lead time from obtaining of the wrong-way vehicle information to distribution thereof, which is caused by computation for determining the distribution target range, can be suppressed, and the wrong-way vehicle information can be quickly distributed.

According to the above examples, the caution about the wrong-way vehicle can be appropriately sent by using quickly provided information showing the presence of the wrong-way vehicle.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying inventive principles.

For example, the configuration of each of the described examples may not only be used by themselves, but also be combined with any of the configurations disclosed in the other examples as long as no consistency arises.

According to the above examples, the traffic information TI (the wrong-way vehicle information) is distributed in response to the distribution request information TREQ from the receiving system 4. However, the distribution system 3 may distribute the traffic information TI regardless whether the distribution request information TREQ from the receiving system 4 is present or not. In this case, in the case of distributing the traffic information TI according to the flowchart shown in FIGS. 6A and 6B (in the case where the distribution system 3 limits the distribution destination to the reporting range C), the traffic information TI is distributed such that a vehicle existing in the reporting range C can receive the traffic information TI. For example, it is preferable to distribute the traffic information TI via an antenna (a roadside antenna) installed on the roadside of the traveling lane H in the reporting range C.

According to the above examples, the probe vehicle 80 is the wrong-way vehicle 100 and the probe vehicle 80 itself sends to the distribution system 3 the travel condition information DI indicating that the probe vehicle 80 is in the wrong-way state. However, the probe vehicle 80 having the camera 51 mounted thereon may detect other vehicle as the wrong-way vehicle 100 and may notify the distribution system 3 of the detection. Alternatively, the probe vehicle 80 notified by the wrong-way vehicle 100 via car-to-car communication may send the information on the wrong-way vehicle 100 to the distribution system 3 based on the information obtained by the car-to-car communication.

According to the above examples, the wrong-way vehicle information including the position information of the wrong-way vehicle 100 (the information on the wrong-way vehicle detection position p81) is distributed. However, the wrong-way vehicle information may merely indicate the road section S where the wrong-way vehicle 100 is present, or the reporting range C.

What is claimed is:

1. A traffic information distribution system that distributes, to a target vehicle, traffic information including information on a wrong-way vehicle traveling in a wrong-way direction opposite to a designated travel direction of a road, the system comprising:

a controller that:

distributes the traffic information to the target vehicle, the target vehicle being a different vehicle than the wrong-way vehicle;

determines a reporting range of the wrong-way vehicle information based on a wrong-way vehicle position, each section of the road being set between two adjacent branch points on the road, a wrong-way section being the road section in which the wrong-way vehicle is present;

when an end-point distance is equal to or larger than a predetermined reference distance, sets the wrong-way section as the reporting range, the end-point distance being a distance between an end point located on the wrong-way direction side of the wrong-way section and the wrong-way vehicle position;

when the end-point distance is less than the reference distance, sets the wrong-way section and at least one road section which is adjacent to the wrong-way section in the wrong-way direction as the reporting range; and when the target vehicle is in the reporting range, sends the traffic information including the wrong-way vehicle information to the target vehicle.

2. The traffic information distribution system according to claim 1, wherein:

each of the road sections is set between two adjacent branch points on a traveling lane of a highway; and each of the branch points is a branch point between the traveling lane and a connection road between the traveling lane and a highway facility including at least an interchange.

3. The traffic information distribution system according to claim 1, wherein the controller:

receives, from the target vehicle, distribution request information requesting distribution of the traffic information;

receives information on a position where the target vehicle is present; and when it is determined, based on the target vehicle position information, that the target vehicle is present in the reporting range, sends the wrong-way vehicle information to the target vehicle in response to the distribution request information.

4. A traffic information system, comprising:

the traffic information distribution system according to claim 1; and a traffic information receiving system that is mounted on the target vehicle and receives the wrong-way vehicle information, the wrong-way vehicle information including information on the wrong-way vehicle position, the traffic information receiving system comprising a second controller that:

successively locates the position where the target vehicle is present;

updates the target vehicle position information; and when it is determined based on the information on the wrong-way vehicle position and the target vehicle position information that the wrong-way vehicle position is located in a travel direction of the target vehicle, sends a caution for an occupant of the target vehicle based on the wrong-way vehicle information.

5. A traffic information system, comprising:

the traffic information distribution system according to claim 1, wherein the controller sends the traffic information including both the wrong-way vehicle information and reporting range information indicating the reporting range of the wrong-way vehicle information; and a traffic information receiving system comprising a second controller that:

successively locates the position where the target vehicle is present;

updates the target vehicle position information; and when it is determined based on the target vehicle position information that the target vehicle is present in the reporting range, sends a caution for an occupant of the target vehicle based on the wrong-way vehicle information.

6. The traffic information system according to claim 5, wherein:

the controller sends the wrong-way vehicle information including information on the wrong-way vehicle position; and when it is determined based on the information on the wrong-way vehicle position and the target vehicle position information that the wrong-way vehicle position is located in a travel direction of the target vehicle, the second controller sends the caution based on the wrong-way vehicle information.

7. A traffic information distribution method for distributing, to a target vehicle, traffic information including information on a wrong-way vehicle traveling in a wrong-way direction opposite to a designated travel direction of a road, the method comprising:

distributing the traffic information to the target vehicle, the target vehicle being a different vehicle than the wrong-way vehicle;

determining a reporting range of the wrong-way vehicle information based on a wrong-way vehicle position, each section of the road being set between two adjacent branch points on the road, a wrong-way section being the road section in which the wrong-way vehicle is present;

when an end-point distance is equal to or larger than a predetermined reference distance, setting the wrong-way section as the reporting range, the end-point distance being a distance between an end point located on the wrong-way direction side of the wrong-way section and the wrong-way vehicle position;

when the end-point distance is less than the reference distance, setting the wrong-way section and at least one road section which is adjacent to the wrong-way section in the wrong-way direction as the reporting range; and when the target vehicle is in the reporting range, sending the traffic information including the wrong-way vehicle information to the target vehicle.

8. The traffic information distribution method according to claim 7, wherein:

each of the road sections is set between two adjacent branch points on a traveling lane of a highway; and each of the branch points is a branch point between the traveling lane and a connection road between the traveling lane and a highway facility including at least an interchange.

9. The traffic information distribution method according to claim 7, further comprising:

receiving, from the target vehicle, distribution request information requesting distribution of the traffic information;

receiving information on a position where the target vehicle is present; and when it is determined, based on the target vehicle position information, that the target vehicle is present in the reporting range, sending the wrong-way vehicle information to the target vehicle in response to the distribution request information.

10. The traffic information distribution method according to claim 7, wherein:

the wrong-way vehicle information includes information on the wrong-way vehicle position; and the method further comprises:

successively locating the position where the target vehicle is present;

updating the target vehicle position information; and when it is determined based on the information on the wrong-way vehicle position and the target vehicle position information that the wrong-way vehicle position is located in a travel direction of the target vehicle, sending a caution for an occupant of the target vehicle based on the wrong-way vehicle information.

11. The traffic information distribution method according to claim 7, further comprising:

sending the traffic information including both the wrong-way vehicle information and reporting range information indicating the reporting range of the wrong-way vehicle information;

successively locating the position where the target vehicle is present;

updating the target vehicle position information; and when it is determined based on the target vehicle position information that the target vehicle is present in the reporting range, sending a caution for an occupant of the target vehicle based on the wrong-way vehicle information.

12. The traffic information system according to claim 11, further comprising sending the wrong-way vehicle information including information on the wrong-way vehicle position; and when it is determined based on the information on the wrong-way vehicle position and the target vehicle position information that the wrong-way vehicle position is located in a travel direction of the target vehicle, sending the caution based on the wrong-way vehicle information.

13. A computer-readable storage medium storing a computer-executable traffic information distribution program usable to distribute, to a target vehicle, traffic information including information on a wrong-way vehicle traveling in a wrong-way direction opposite to a designated travel direction of a road, the program comprising:

instructions for distributing the traffic information to the target vehicle, the target vehicle being a different vehicle than the wrong-way vehicle;

instructions for determining a reporting range of the wrong-way vehicle information based on a wrong-way vehicle position, each section of the road being set between two adjacent branch points on the road, a wrong-way section being the road section in which the wrong-way vehicle is present;

instructions for, when an end-point distance is equal to or larger than a predetermined reference distance, setting the wrong-way section as the reporting range, the end-point distance being a distance between an end point located on the wrong-way direction side of the wrong-way section and the wrong-way vehicle position;

instructions for, when the end-point distance is less than the reference distance, setting the wrong-way section and at least one road section which is adjacent to the wrong-way section in the wrong-way direction as the reporting range; and instructions for, when the target vehicle is in the reporting range, sending the traffic information including the wrong-way vehicle information to the target vehicle.

* * * * *